US011344179B2

(12) United States Patent
Nearpass et al.

(10) Patent No.: US 11,344,179 B2
(45) Date of Patent: May 31, 2022

(54) DISH TREATING APPLIANCE WITH A DISH RACK AND RAIL ASSEMBLY

(71) Applicant: WHIRLPOOL CORPORATION, Benton Harbor, MI (US)

(72) Inventors: Charles Ellsworth Nearpass, Berrien Springs, MI (US); Thomas Matthew O'Brien, Saint Joseph, MI (US); Benjamin Nicholas Fulbright, Berrien Springs, MI (US); Michael Earl Gatt, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 228 days.

(21) Appl. No.: 16/723,239

(22) Filed: Dec. 20, 2019

(65) Prior Publication Data

US 2021/0186300 A1 Jun. 24, 2021

(51) Int. Cl.
*A47L 15/42* (2006.01)
*A47L 15/50* (2006.01)

(52) U.S. Cl.
CPC ..... *A47L 15/507* (2013.01); *A47L 15/4246* (2013.01)

(58) Field of Classification Search
None
See application file for complete search history.

(56) References Cited

U.S. PATENT DOCUMENTS

| | | | | |
|---|---|---|---|---|
| 2,648,588 | A | 8/1953 | Ruspino | |
| 7,404,410 | B2 | 7/2008 | Pardini | |
| 7,731,805 | B2 | 6/2010 | Banta et al. | |
| 8,220,472 | B2 | 7/2012 | Kaczmarek | |
| 10,034,597 | B1 | 7/2018 | Maddux et al. | |
| 10,299,657 | B2 | 5/2019 | Wilson et al. | |
| 2008/0129168 | A1* | 6/2008 | Banta | A47L 15/506 312/333 |
| 2012/0139399 | A1 | 6/2012 | McDaniel | |

FOREIGN PATENT DOCUMENTS

| | | | |
|---|---|---|---|
| CN | 109008860 | A | 12/2018 |
| CN | 109674424 | A | 4/2019 |
| CN | 109691941 | A | 4/2019 |
| EP | 3338614 | B1 | 9/2019 |
| WO | 07055679 | A1 | 5/2007 |

OTHER PUBLICATIONS

European Patent Office, European Extended Search Report re Corresponding Application No. 202003963.2-1016, dated Mar. 19, 2021.

* cited by examiner

*Primary Examiner* — Levon J Shahinian
(74) *Attorney, Agent, or Firm* — McGarry Bair PC

(57) ABSTRACT

A dish treating appliance for treating dishes according to an automatic cycle of operation can include a tub having at least a rear wall, a bottom wall, and a pair of opposing side walls. The tub at least partially defines a treating chamber with an access opening. A rail mounting assembly includes a pair of braces. Each of the braces are coupled with a different one of the opposing side walls. A rail assembly is mounted to each of the braces. A dish rack is slidingly mounted to the rail assemblies for movement in and out of the treating chamber relative to the access opening.

18 Claims, 23 Drawing Sheets

DISH TREATING APPLIANCE WITH A DISH RACK AND RAIL ASSEMBLY

BACKGROUND

Contemporary automatic dish treating appliances for use in a typical household include a tub that can have an open front and at least partially defines a treating chamber into which dishes can be placed to undergo a treating operation, such as washing. A spraying system with multiple sprayers can be provided for recirculating liquid throughout the tub to remove soils from the dishes. The spraying system can include various sprayers.

At least one dish rack or basket for supporting various types of soiled dishes can be provided within the tub. Traditionally, a dish treating appliance includes an upper rack that holds glassware and small dishes, and a lower rack that holds larger dishes, such as plates. These two dish racks usually consume most of the space inside the dishwasher tub. Some dishwashers can also include a third dish rack, often for silverware or other low profile utensils. A silverware or utensil basket for holding utensils, silverware, cutlery, and the like, can also be provided and is generally removably mounted to the door or within the dish rack.

BRIEF DESCRIPTION

An aspect of the present disclosure relates to a dish treating appliance for treating dishes according to an automatic cycle of operation, the dish treating appliance comprising a tub having at least a rear wall, a bottom wall, and a pair of opposing side walls and at least partially defining a treating chamber with an access opening, a rail mounting assembly comprising a pair of rail mounting braces, each rail mounting brace biased outwardly against a different one of the opposing side walls, a rail assembly mounted to each rail mounting brace, and a dish rack slidingly mounted to the rail assemblies for movement in and out of the treating chamber relative to the access opening.

Another aspect of the present disclosure relates to a dish treating appliance for treating dishes according to an automatic cycle of operation, the dish treating appliance comprising a tub having at least a rear wall, a bottom wall, and a pair of opposing side walls and at least partially defining a treating chamber with an access opening, a rail mounting assembly comprising a rear brace provided along the rear wall and extending between the side walls to define opposing ends, a pair of side braces, each of the side braces rotatably coupled to one of the opposing ends to rotate outwardly from the rear brace into an installed position, where each side brace extends along a different one of the opposing side walls, between the rear wall and the access opening, and a rail assembly mounted to each side brace, and a dish rack slidingly mounted to the rail assemblies for movement in and out of the treating chamber relative to the access opening.

Yet another aspect of the present disclosure relates to a dish treating appliance for treating dishes according to an automatic cycle of operation, the dish treating appliance comprising a tub having at least a rear wall, a bottom wall, and a pair of opposing side walls and at least partially defining a treating chamber with an access opening, a rail mounting assembly comprising a pair of rail mounting braces, each rail mounting brace coupled with a different one of the opposing side walls without the use of fasteners passing through the tub walls, a rail assembly mounted to each of the rail mounting braces, and a dish rack slidingly mounted to the rail assemblies for movement in and out of the treating chamber relative to the access opening.

DETAILED DESCRIPTION

Figure 1:
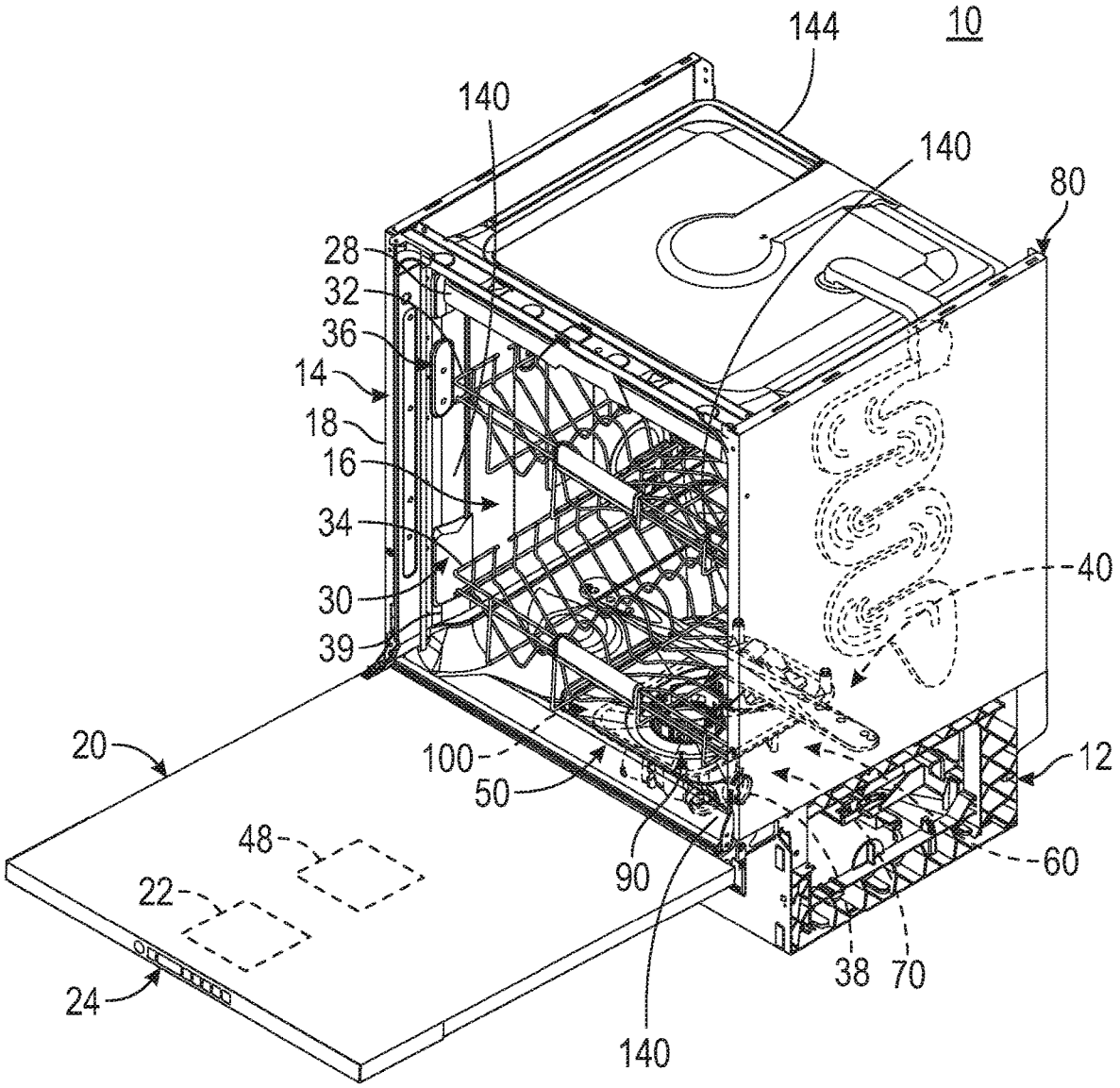
FIG. 1 is a right-side perspective view of a dish treating appliance, illustrated herein as a dishwasher, having multiple systems for implementing an automatic cycle of operation.

FIG. 1 illustrates an automatic dish treating appliance, illustrated herein as a dishwasher 10, capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, silverware, and other utensils. As illustrated, the dishwasher 10 is a built-in dishwasher implementation, which is designed for mounting under a countertop. However, this description is applicable to other dishwasher implementations such as a stand-alone, multi-tub-type, drawer-type, or a sink-type, for example, as well as dishwashers having varying widths, sizes, and capacities. The dishwasher 10 shares many features of a conventional automatic dishwasher, which may not be described in detail herein except as necessary for a complete understanding of aspects of the disclosure.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an access opening, illustrated herein as an open face 18, for receiving the dishes. The open-faced tub 14 can have at least a pair of opposing side walls 140 that are spaced apart from one another, such as by being spaced apart by a bottom wall 142 or a rear wall 144. The pair of opposing side walls 140, the bottom wall 142, and the rear wall 144 can further be thought of as at least partially defining the treating chamber 16, and optionally also the open face 18 to serve as the access opening.

A closure in the form of a door assembly 20 can be hingedly or pivotally mounted to the base 12 for movement relative to the tub 14 between opened and closed positions to selectively open and close the open face 18 of the tub 14. In the opened position, a user can access the treating chamber 16, as shown in FIG. 1, while, in the closed position (not shown), the door assembly 20 covers or closes the open face 18 of the treating chamber 16. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame by which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include a dish holding system 30, spray system 40, recirculation system 50, drain system 60, water supply system 70, drying system 80, heating system 90, and filter system 100. These systems are used to implement one or more treating cycles of operation for the dishes, for which there are many, one of which includes a traditional automatic wash cycle.

A basic traditional automatic cycle of operation for the dishwasher 10 has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The amounts of water, treating chemistry, and/or rinse aid used during each of the multiple wash or rinse steps can be varied. The wash phases and rinse phases can include the heating of the water, even to the point of one or more of the phases being hot enough for long enough to sanitize the dishes. A drying phase can follow the rinse phase(s). The drying phase can include a drip dry, a non-heated drying step (so-called "air only"), heated dry, condensing dry, air dry or any combination. These multiple phases or steps can also be performed by the dishwasher 10 in any desired combination.

A controller 22 can also be included in the dishwasher 10 and operably couples with and controls the various components of the dishwasher 10 to implement the cycles of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can provide an input and output function for the controller 22.

The user interface 24 can include operational controls such as one or more knobs, dials, lights, switches, displays, touch screens and the like for communicating with the user, such as enabling a user to input commands, such as a cycle of operation, to the controller 22 and to receive information, for example about the selected cycle of operation. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the dishwasher 10 and can allow the controller 22 to communicate with the user in a variety of ways. For example, the controller 22 can be configured to send a text message to the user, send an electronic mail to the user, or provide audio information to the user either through the dishwasher 10 or utilizing another device such as a mobile phone.

The controller 22 can include the machine controller and any additional controllers provided for controlling any of the components of the dishwasher 10. For example, the controller 22 can include the machine controller and a motor controller. Many known types of controllers can be used for the controller 22. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

The dish holding system 30 can include any suitable structure or structures for receiving or holding dishes within the treating chamber 16. Exemplary dish holders are illustrated in the form of an upper dish rack 32 and lower dish rack 34, commonly referred to as "racks", which are located within the treating chamber 16. The upper dish rack 32 and the lower dish rack 34 each define an interior and are typically mounted for slidable movement in and out of the treating chamber 16 through the open face 18 for ease of loading and unloading. In one example, it is common for the the upper dish rack 32 to be slidably mounted within and to the tub 14 by the use of a suitable drawer withdrawal assembly, such as by the use of drawer guides, slides, or rails 36, while the lower dish rack 34 is instead typically provided with wheels or rollers 38 that can roll along a travel path 39 defined by at least a portion of the dishwasher 10. For example, it is typical for the lower dish rack 34 to be slidable along the travel path 39 such that the lower dish rack 34 can roll along the travel path 39 and then continue to roll onto the door assembly 20, when the door assembly 20 is in the opened position and allows for withdrawal of the dish racks 32, 34.

By way of further example, in such a case, it is also typical that the travel path 39 can include a type of rails 39, but that rails 39 for the lower dish rack 34 may differ in structure from the rails 36 for the upper dish rack 32, and in particular such that the rails 39 may be provided simply as a ledge or a surface formed by the tub 14, such as formed or carried by the side walls 140 or the bottom wall 142 of the tub 14. By providing the rails 39 for the lower dish rack 34 as a simpler support surface, such as a ledge, rather than a more restrictive or enclosing structure such as the rails 36, the rails 39 are better able to accommodate movement or instability of the lower dish rack 34 as the lower dish rack 34 rolls onto the door assembly 20, going from the static, stable tub 14 to the movable door assembly 20. In this way, the rails 39 allow more tolerance for movement as the lower dish rack 34 rolls along the door assembly 20.

In addition, dedicated dish holders can also be provided. One such dedicated dish holder is a third level rack 28 located above the upper dish rack 32. Like the upper dish rack 32, the third level rack 28 is slidably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack 28, it can be washed in the third level rack 28. The third level rack 28 generally has a much shorter height or lower profile than the upper and lower dish racks 32, 34. Typically, the height of the third level rack 28 is short enough that a typical glass cannot be stood vertically in the third level rack 28 and the third level rack 28 still be slid into the treating chamber 16.

Another dedicated dish holder can be a utensil or silverware basket (not shown), which is typically located in the treating chamber 16 and carried by one of the upper or lower dish racks 32, 34 or mounted to the door assembly 20. The silverware basket typically holds utensils and the like in an upright orientation as compared to the on-the-side or flat orientation of the third level rack 28. More than one silverware basket can be provided with the dishwasher 10.

A dispenser assembly 48 is provided to store and dispense treating chemistry, e.g. detergent, anti-spotting agent, etc., into the treating chamber 16. The dispenser assembly 48 can be mounted on an inner surface of the door assembly 20, as shown, or can be located at other positions within the chassis or treating chamber 16, such that the dispenser assembly 48 is positioned to be accessed by the user for refilling of the dispenser assembly 48, whether it is necessary to refill the dispenser assembly 48 before each cycle (i.e. for a single use dispenser) or only periodically (i.e. for a bulk dispenser). The dispenser assembly 48 can dispense one or more types of treating chemistries. The dispenser assembly 48 can be a single-use dispenser, which holds a single dose of treating chemistry, or a bulk dispenser, which holds a bulk supply of treating chemistry and which is adapted to dispense a dose of treating chemistry from the bulk supply during the cycle of operation, or a combination of both a single use and bulk dispenser. The dispenser assembly 48 can further be configured to hold multiple different treating chemistries. For example, the dispenser assembly 48 can have multiple compartments defining different chambers in which treating chemistries can be held.

Figure 2:
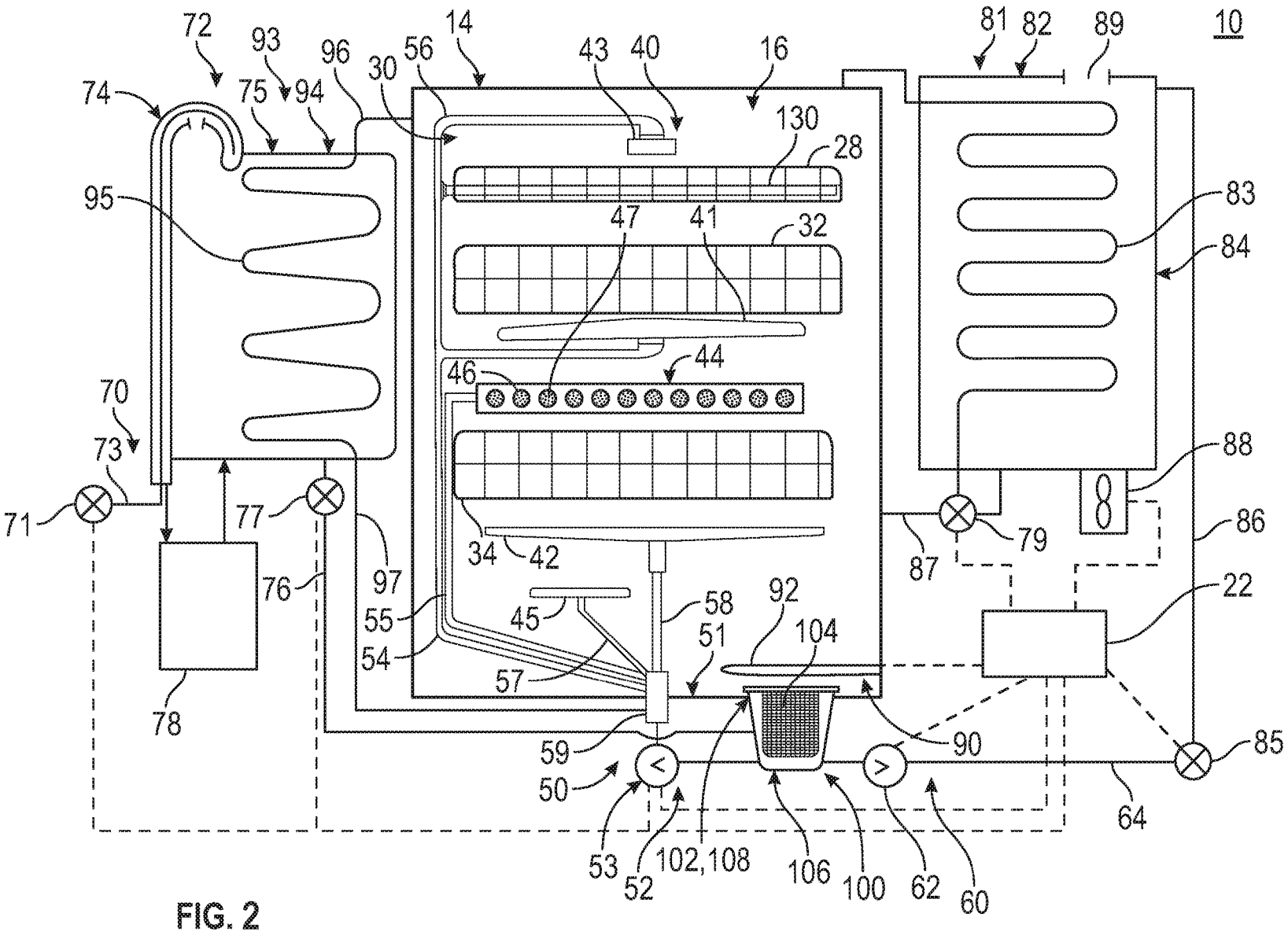
FIG. 2 is a schematic view of the dishwasher of FIG. 1 and illustrating at least some of the systems.

Turning to FIG. 2, the spray system 40 is provided for spraying liquid in the treating chamber 16 and can have multiple spray assemblies or sprayers 41, 42, 43, 44, 45, 130, some of which can be dedicated to a particular one of the dish holders, to particular area of a dish holder, to a particular type of cleaning, or to a particular level of cleaning, etc. The sprayers 41, 42, 43, 44, 45, 130 can be fixed or movable, such as rotating, relative to the treating chamber 16 or dish holder. Exemplary sprayers 41, 42, 43, 44, 45, 130 are illustrated and include an upper spray arm 41, a lower spray arm 42, a third level sprayer 43, a deep-clean sprayer 44, and a spot sprayer 45. The upper spray arm 41 and lower spray arm 42 can be rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, a sprayer 130 can be located at least in part below a portion of the third level rack 28, though it will be understood that such a sprayer 130 can be provided adjacent any of the racks 28, 32, 34. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or can move, such as by way of rotating. The spray emitted by the deep-clean sprayer 44 defines a deep clean zone, which, as illustrated, would extend along a rear side of the lower dish rack 34. Thus, dishes needing deep cleaning, such as dishes with baked-on food, can be positioned in the lower dish rack 34 to face the deep-clean sprayer 44. The deep-clean sprayer 44, while illustrated as only one unit on a rear wall of the tub 14, could comprise multiple units and/or extend along multiple portions, including different walls, of the tub 14, and can be provided above, below, or beside any of the dish holders 28, 32, 34 wherein deep cleaning is desired.

The spot sprayer 45, like the deep-clean sprayer 44, can emit an intensified and/or higher pressure spray, especially to a discrete location within one of the dish holders 28, 32, 34. While the spot sprayer 45 is shown below the lower dish rack 34, it could be adjacent any part of any dish holder 28, 32, 34 or along any wall of the tub 14 where special cleaning is desired. In the illustrated location below the lower dish rack 34, the spot sprayer 45 can be used independently of or in combination with the lower spray arm 42. The spot sprayer 45 can be fixed or can move, such as in rotating.

These sprayers 41, 42, 43, 44, 45, 130 are illustrative examples of suitable sprayers and are not meant to be limiting as to the type of suitable sprayers 41, 42, 43, 44, 45, 130. Additionally, it will be understood that not all of the exemplary sprayers 41, 42, 43, 44, 45, 130 need be included within the dishwasher 10, and that less than all of the sprayers 41, 42, 43, 44, 45, 130 described can be included in a suitable dishwasher 10.

The recirculation system 50 recirculates the liquid sprayed into the treating chamber 16 by the sprayers 41, 42, 43, 44, 45, 130 of the spray system 40 back to the sprayers 41, 42, 43, 44, 45, 130 to form a recirculation loop or circuit by which liquid can be repeatedly and/or continuously sprayed onto dishes in the dish holders 28, 32, 34. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52.

Multiple supply conduits 54, 55, 56, 57, 58 fluidly couple the sprayers 41, 42, 43, 44, 45, 130 to the recirculation pump 53. A recirculation valve 59 can selectively fluidly couple each of the conduits 54, 55, 56, 57, 58 to the recirculation pump 53. While each sprayer 41, 42, 43, 44, 45, 130 is illustrated as having a corresponding dedicated supply conduit 54, 55, 56, 57, 58, one or more subsets, comprising multiple sprayers from the total group of sprayers 41, 42, 43, 44, 45, 130, can be supplied by the same conduit, negating the need for a dedicated conduit 54, 55, 56, 57, 58 for each sprayer 41, 42, 43, 44, 45, 130. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits 54, 55, 56, 57, 58 can be directly coupled to the recirculation pump 53, while one or more of the other conduits 54, 55, 56, 57, 58 can be selectively coupled to the recirculation pump 53 with one or more valves. There are essentially an unlimited number of plumbing schemes to connect the recirculation system 50 to the spray system 40. The illustrated plumbing is not limiting.

The drain system 60 drains liquid from the treating chamber 16. The drain system 60 includes a drain pump 62 fluidly coupling the treating chamber 16 to a drain line 64. As illustrated, the drain pump 62 fluidly couples the sump 51 to the drain line 64.

While separate recirculation 53 and drain pumps 62 are illustrated, a single pump can be used to perform both the recirculating and the draining functions, such as by configuring the single pump to rotate in opposite directions, or by providing a suitable valve system. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to at least some extent.

A water supply system 70 is provided for supplying fresh water to the dishwasher 10 from a water supply source, such as a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit 73 is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 can be provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system 80 as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70, such that liquid can be supplied to the cooling tank 84. The liquid provided to the cooling tank 84 from any of the systems 40, 50, 60, 70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected based on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater 92, located in the treating chamber 16 at a location where it will be immersed by the water supplied to the treating chamber 16, such as within or near the sump 51. However, it will also be understood that the heater 92 need not be an immersion heater 92; it can also be an in-line heater located in any of the conduits. There can also be more than one heater 92, including both an immersion heater 92 and an in-line heater. The heater 92 can also heat air contained in the treating chamber 16. Alternatively, a separate heating element (not shown) can be provided for heating the air circulated through the treating chamber 16.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated, such as an ultrafiltration system.

Figure 3:
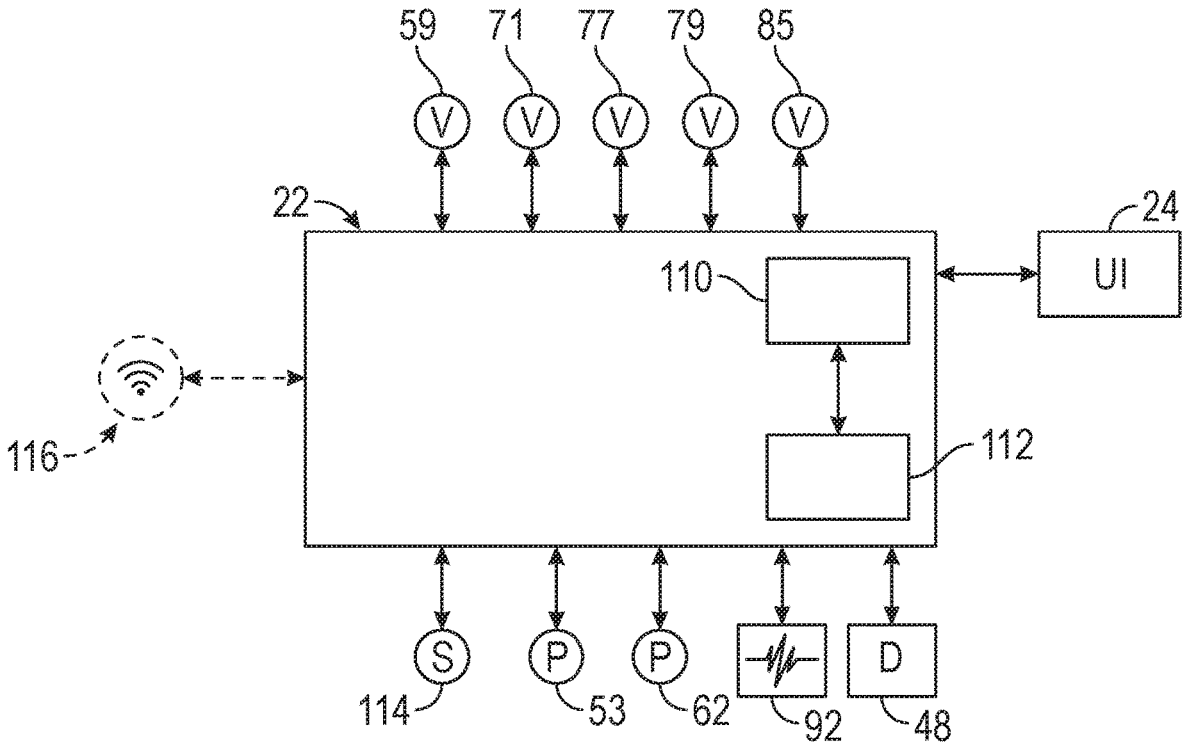
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, the recirculation pump 53 for recirculating the wash liquid during the cycle of operation, the user interface 24 for receiving user selected inputs and communicating information to the user, and the dispenser assembly 48 for selectively dispensing treating chemistry to the treating chamber 16. The controller 22 can also communicate with the recirculation valve 59, the household water valve 71, the controllable valve 77, the return valve 79, and the valve 85 to selectively control the flow of liquid within the dishwasher 10. Optionally, the controller 22 can include or communicate with a wireless communication device 116.

The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store a set of executable instructions including one or more pre-programmed automatic cycles of operation that can be selected by a user and executed by the dishwasher 10. Examples, without limitation, of cycles of operation include: wash, heavy duty wash, delicate wash, quick wash, pre-wash, refresh, rinse only, timed wash, dry, heavy duty dry, delicate dry, quick dry, or automatic dry, which can be selected at the user interface 24. The memory 110 can also be used to store information, such as a database or table, and to store data received from one or more components of the dishwasher 10 that can be communicably coupled with the controller 22. The database or table can be used to store the various operating parameters for the one or more cycles of operation, including factory default values for the operating parameters and any adjustments to them by the control assembly or by user input.

The controller 22 can also receive input from one or more sensors 114 provided in one or more of the assemblies or systems of the dishwasher 10 to receive input from the sensors 114, which are known in the art and not shown for simplicity. Non-limiting examples of sensors 114 that can be communicably coupled with the controller 22 include, to name a few, an ambient air temperature sensor, a treating chamber temperature sensor, such as a thermistor, a water supply temperature sensor, a door open/close sensor, a moisture sensor, a chemical sensor, and a turbidity sensor to determine the soil load associated with a selected grouping of dishes, such as the dishes associated with a particular area of the treating chamber 16.

Figure 4:
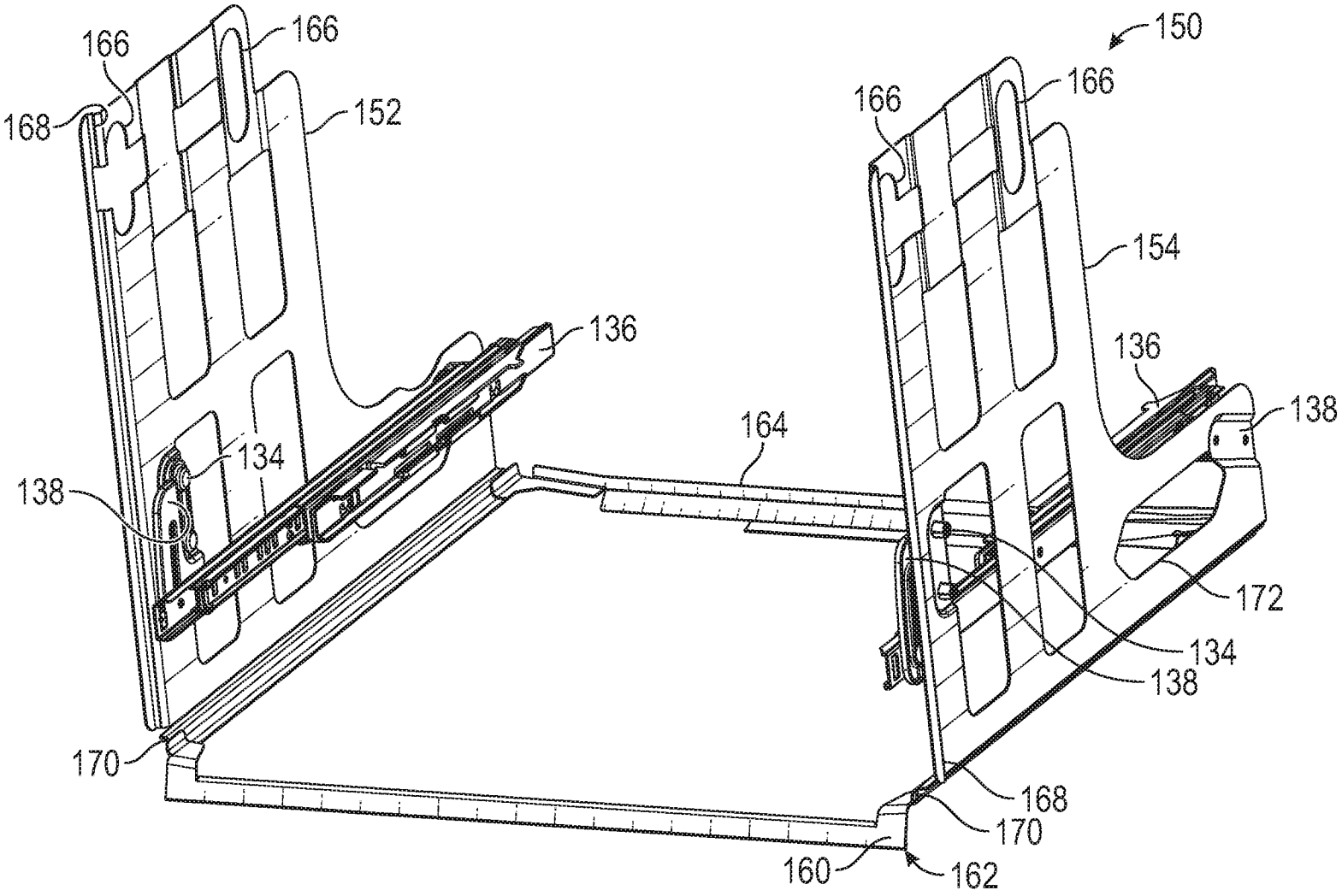
FIG. 4 is a perspective view of an example of a rail mounting assembly for use with the dishwasher of FIG. 1.

Turning now to FIG. 4, as described previously with respect to FIG. 1, the rails 39 that can be provided with the lower dish rack 34 may be provided with a simpler, less restrictive structure, such as a ledge or a support surface, than as compared to the rails 36 provided with the upper dish rack 32, which can allow more tolerance for movement as the lower dish rack 34 rolls onto or along the door assembly 20. However, the use of such rails 39 with the lower dish rack 34 and its travel along the door assembly 20 may result in the lower dish rack 34 being perceived as being less stable or as being more likely to depart from the travel path 39 of the rails 39 as the lower dish rack 34 rolls onto the door assembly 20, as compared to the use of such rails 36, as are included with the upper dish rack 32. Thus, it may be desirable to also provide the lower dish rack 34 with at least one rail assembly 136, illustrated herein as a pair of opposing rail assemblies 136, and which can be similar to the rails 36, but are not limited to the features of the rails 36, despite that the inclusion of the rail assemblies 136, in turn, provides additional challenges for the design and manufacture of the dishwasher 10.

Specifically, in order to provide the rail assemblies 136 with the lower dish rack 34, attachment of such rail assemblies 136 may include putting additional holes in the tub 14, and specifically in the side walls 140, for mounting such rail assemblies 136. Further, providing the rail assemblies 136 with the lower dish rack 34 may include an increased cost of manufacture, and also can impact the capacity of the dishwasher 10 and the treating chamber 16, and specifically of the lower dish rack 34, due to the additional space required for the provision of such rail assemblies 136, such as by potentially necessitating a corresponding reduction in the size and capacity of the lower dish rack 34 in order to accommodate the space occupied by the rail assemblies 136 and associated mounting structures. Therefore, it may be desirable to provide methods and structures that can allow for including and mounting the rail assemblies 136, for use with the lower dish rack 34, while avoiding the need for providing additional holes, such as for fasteners, in the tub 14, such as through the side walls 140, and further while minimizing or avoiding increases in the manufacturing cost, such as due to increased labor costs associated with potentially complex installation procedures, as well as minimizing or avoiding negative impacts on the capacity of the lower dish rack 34, and therefore also of the treating chamber 16 and of the dishwasher 10.

In one example for such an approach and to address these considerations while providing the rail assemblies 136 for the lower dish rack 34, and specifically referring now to FIG. 4, a rail mounting assembly 150 can be provided within the dishwasher 10 and for use with the lower dish rack 34 and the rail assemblies 136. The rail mounting assembly 150 comprises a pair of rail mounting braces 152, 154, illustrated herein as a first rail mounting brace 152 and a second rail mounting brace 154, the rail mounting braces 152, 154 spaced apart from one another. Specifically, the rail mounting braces 152, 154 can be spaced laterally, such as horizontally, from one another such that the first rail mounting brace 152 is positioned adjacent one of the side walls 140, while the second rail mounting brace 152 is positioned adjacent the opposite side wall 140. In the case that the first and second rail mounting braces 152, 154 are provided opposite one another along opposite side walls 140 of the tub 14, it is contemplated that the first and second rail mounting braces 152, 154 can be provided as left and right rail mounting braces 152, 154 that are structured so as to be flipped or as mirror images to one another.

Each rail assembly 136 of the pair of rail assemblies 136, as illustrated herein, is mounted to a different one of the rail mounting braces 152, 154. Thus, the rail assemblies 136 can similarly be thought of as first and second rail assemblies 136 spaced apart from one another for mounting with the rail mounting braces 152, 154, respectively. Further, the first rail assembly 136 can mount to the first rail mounting brace 152, while the second rail assembly 136 can mount to the second rail mounting brace 154, such that the pairs of the rail assemblies 136 with the rail mounting braces 152, 154 can be thought of as being spaced apart from one another, and specifically such that the first pair, consisting of the first rail assembly 136 mounted to the first rail mounting brace 152, is positioned adjacent one of the side walls 140, while the second pair, consisting of the second rail assembly 136 mounted to the second rail mounting brace 154, is positioned adjacent the opposite side wall 140. Further still, and similarly to the first and second rail mounting braces 152, 154, in the case that the first and second rail assemblies 136 are provided opposite one another along opposite side walls 140 of the tub 14, it is contemplated that the first and second rail assemblies 136 can be provided as left and right rail assemblies 136 that are structured so as to be flipped, or as mirror images to one another. In this way, the pairs of the rail assemblies 136 with the rail mounting braces 152, 154 can also be thought of in the same way, such that the pairs are mirror images to one another.

The mounting of each rail assembly 136 to the corresponding one or the other of the rail mounting braces 152, 154 can be accomplished by any suitable mounting method for coupling each rail assembly 136 to each rail mounting brace 152, 154. In one example, each rail assembly 136 can further comprise at least one mounting bracket 138, with each mounting bracket 138 including or being coupled with at least one fastening element 134. For example, each pair of the rail assembly 136 with the rail mounting brace 152, 154 can include at least two mounting brackets 138, such that one mounting bracket 138 can be provided to support each end of the rail assembly 136 for improved stability. Each mounting bracket 138 can be coupled together with one rail assembly 136 and one of the rail mounting braces 152, 154, such that the one mounting bracket 138 serves to couple the one rail assembly 136 to the one rail mounting brace 152, 154. The fastening elements 134 can be used either for fastening the rail assembly 136 to the mounting bracket 138, or for fastening the mounting bracket 138 to the rail mounting brace 152, 154, or for both purposes.

In one example, the mounting bracket 138 can be mounted to the rail mounting brace 152, 154 in such a way that at least one fastening element 134 extends through the rail mounting brace 152, 154 for each mounting bracket 138 that is mounted to the rail mounting brace 152, 154. In this way, by including fastening elements 134 to extend through the rail mounting brace 152, 154, it can be possible to then mount the rail mounting brace 152, 154, and, in turn, also the rail assembly 136, within the tub 14 of the dishwasher 10 without passing additional fasteners through the walls 140, 142, 144 of the tub 14. In a further example, the rail mounting assembly 150 can instead be coupled and retained within the tub 14 by other structures, means, or methods. By way of non-limiting example, the rail mounting assembly 150 can include a variety of features that couple the rail mounting assembly 150 with the tub 14 without the use of fastening elements 134 passing through the tub 14, such as by the inclusion of complementary or cooperating structures, by using existing structures within the tub 14 to retain the rail mounting assembly 150, or by biasing the rail mounting braces 152, 154 outwardly against at least a portion of the tub 14.

In one aspect, by mounting the rail assembly 136 to the rail mounting brace 152, 154 via the mounting bracket 138 and with the at least one fastening element 134 passing through the rail mounting brace 152, 154, the rail mounting brace 152, 154 can then be capable of or configured for mounting within the tub 14 without the need to include additional fastening elements 134 to pass through the tub 14, such as through the side wall 140. In this way, the rail mounting brace 152, 154, and therefore also the rail mounting assembly 150, can be thought of as mounting the rail assembly 136 to the tub 14 without requiring any additional holes provided with the tub 14 and without the use of any of the fastening elements 134 passing through the tub walls, including the side walls 140. Further still, with the rail mounting assembly 150 provided within the tub 14, the dish rack, such as the lower dish rack 34, can slidingly mount to and between the rail assemblies 136 for movement slidingly in and out of the treating chamber 16 relative to the access opening and to the open face 18 between the opened and closed positions. Thus, the rail mounting braces 152, 154, and therefore also the rail mounting assembly 150, can further be thought of as mounting the rail assembly 136 to the tub 14 without requiring any additional holes provided with the tub 14 and without the use of any of the fastening elements 134 passing through the walls of the tub 14, including the side walls 140.

The rail mounting assembly 150 as illustrated herein includes a variety of features for coupling with, engagement with, alignment with, or for being retained by the tub 14. The rail mounting braces 152, 154, in one example, can be thought of as mounting plates that extend along and are coextensive with a large portion of the surface area of the side walls 140. In one aspect, the rail mounting braces 152, 154 are sized specifically such that the rail mounting braces 152, 154 at least reach the upper dish rack 32 and its associated rails 36, and can further be coupled to the tub 14 by engagement or interaction with the rails 36 for the upper dish rack 32. Each of the rail mounting braces 152, 154 defines at least one mounting opening 166. As illustrated herein, each of the rail mounting braces 152, 154 includes at least two mounting openings 166. These mounting openings 166 can be provided with the rail mounting braces 152, 154 such that they are positioned, sized, and shaped, so as to be complementary with at least portions of the rails 36 and configured for coupling with the rails 36.

The rail mounting braces 152, 154 can further include at least one receiving opening 172 that is further positioned, sized, and shaped so as to receive a structure defined by the tub 14 for further engagement with the tub 14. Each rail mounting brace 152, 154 further comprises a front edge 168, which can be thought of as forming a front lip or a front skirt for further engagement with the tub 14 or with other structures of the dishwasher 10. The front edge 168 can be specifically positioned so as to engage with a feature within the dishwasher 10, such as that the front edge 168 is designed to have a contour that is complementary to and can cooperate with a portion of the tub 14. Similarly, the rail mounting braces 152, 154 can include a downwardly depending flange 170, which can also be thought of as a lip or a skirt, extending from at least a portion of the rail mounting braces 152, 154. As with the front edge 168, the downwardly depending flange 170 can be configured for further engagement with the tub 14 or with other components of the dishwasher 10. The downwardly depending flange 170 can be specifically positioned and shaped so as to engage with or interface with at least a portion of the tub 14.

Further, the rail mounting assembly 150 can include at least one cross brace, and is illustrated herein as including a front cross brace 160 and a rear cross brace 164. Both the front cross brace 160 and the rear cross brace 164 can extend between the opposing rail mounting braces 152, 154, and thus also between the opposing side walls 140, and can have opposing ends that couple with the rail mounting braces 152, 154, respectively, to provide improved stability of the rail mounting braces 152, 154 against the tub 14, and especially the side walls 140. The front cross brace 160 and the rear cross brace 164 can be shaped and contoured so as to engage with or cooperate with features or structures of the tub 14 where they are positioned, such that the front cross brace 160 and the rear cross brace 164 can passively engage with complementary surfaces, such as to rest on a feature of the tub 14 having complementary shape, or alternatively, or additionally, to further interact with another structure of the tub 14, such as to be retained by a portion of the tub 14. In one example, the front cross brace 160 has a portion that extends downwardly to terminate at and to define a front edge 162. The front edge 162 of the front cross brace 160 can be sized, positioned, and configured to be retained by a portion of the tub 14 (FIG. 7) to provide increased stability of the rail mounting assembly 150 and to prevent undesirable movement of the components of the rail mounting assembly 150.

In a further example, at least one of the front cross brace 160 and the rear cross brace 164, or both, is provided, such as by being specifically sized and positioned, such that the front cross brace 160 or the rear cross brace 164 is provided at least partially within the space between the opposing rail mount braces 152, 154 in order to prevent inward movement of either of the rail mount braces 152, 154 from adjacent the side wall 140 and toward the treating chamber 16. In such a case, it will be understood that the front cross brace 160 and the rear cross brace 164 do not need to exert a force on the rail mounting braces 152, 154 during normal operation of the dishwasher 10, but instead can be positioned such that they only prevent further movement of the rail mounting braces 152, 154 when the rail mounting braces 152, 154 once some movement to come into contact with the front cross brace 160 or the rear cross brace 164 has already occurred. In another example, the front cross brace 160 or the rear cross brace 164, or both, can be provided so as to actively bias the rail mounting braces 152, 154 outwardly against the side walls 140, and specifically such that each rail mounting brace 152, 154 is biased outwardly against and abuts a different one of the opposing side walls 140, such as even during normal operation of the dishwasher 10.

Figure 5:
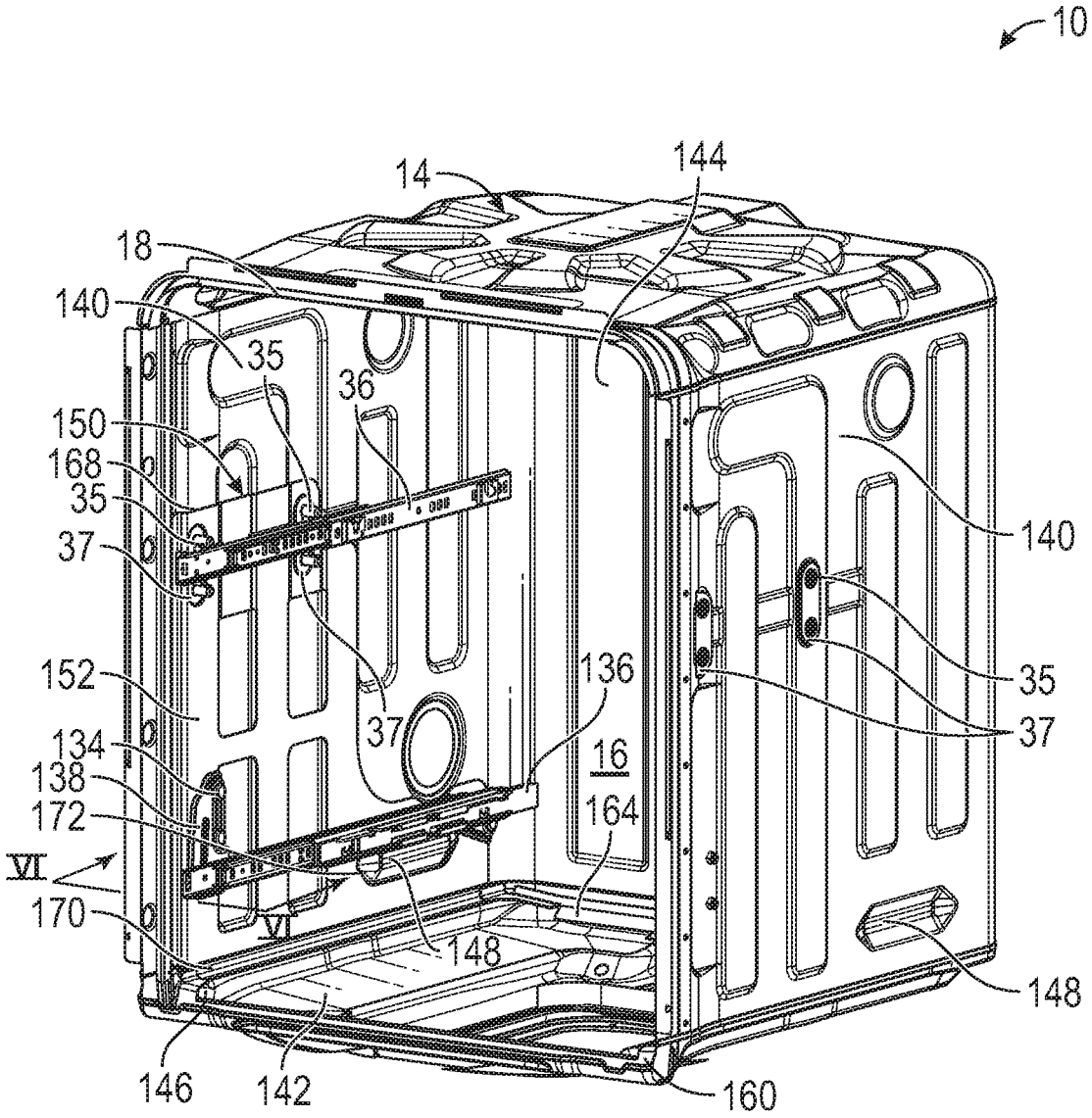
FIG. 5 is a perspective view of the rail mounting assembly of FIG. 4 provided within and coupled with a tub of the dishwasher of FIG. 1.

Turning now to FIG. 5, the rail mounting assembly 150 is shown in an installed position within and coupled to the tub 14 for a better view of the coupling and engagement between the rail mounting assembly 150 and the tub 14. While there are a variety of features and surfaces between the rail mounting assembly 150 and the tub 14 that contact one another, the rail mounting braces 152, 154 are primarily retained within and against the tub 14 by the rails 36 of the upper dish rack 32. The rails 36 of the upper dish rack 32 can be mounted to the tub 14 similarly to the mounting of the rail assemblies 136 to the rail mounting braces 152, 154. Specifically, each of the rails 36 can further comprise at least one mounting element 37, which can be provided as a mounting bracket or as any other suitable type of mounting structure or feature. Further, the mounting elements 37, or at least some of the mounting elements 37 can include a fastener 35 that extends at least partially through the side wall 140 of the tub 14 to mount to the side wall 140. As illustrated herein, each of the rails 36 is mounted by two mounting elements 37, spaced from one another along the length of the rails 36, and with each mounting element 37 comprising two fasteners 35 that extend through the side wall 140, though it will be understood that these examples are not limiting.

Regardless of what the configuration is for the rails 36, mounting elements 37, and fasteners 35, the rail mounting braces 152, 154 can be specifically configured to interface with these features for coupling with the tub 14. By way of further example and as illustrated herein, the mounting openings 166 are shaped, sized, and positioned so as to align with and to at least partially surround and receive the mounting elements 37 of the rails 36, as well as the fasteners 35. Specifically, when the rail mounting assembly 150 is in place within the tub 14, and the rails 36 are not yet mounted to the tub 14, the rail mounting braces 152, 154 can abut and confront the side walls 140 such that the mounting openings 166 are aligned with openings provided in the side wall 140 for mounting the mounting elements 37 and fasteners 35. The rails 36, along with the mounting elements 37 and the fasteners 35, mount to the tub 14 as normal, with the rail mounting brace 152, 154 retained between the rails 36 and the tub 14, such that it can be thought of as constituting an intervening layer in the mounting of the rails 36 to the tub 14. The order of and the specific arrangement of the layers corresponding to the various components is not essential, such that it will be understood that some combination of at least one of the tub 14, the rails 36, the mounting elements 37, and the fasteners 35 are retaining and biasing the rail mounting braces 152, 154 within the tub 14 and against the side walls 140.

In addition to coupling with the tub 14 via the rails 36 and associated components, the rail mounting assembly 150 can engage with various other features. For example, though better seen in FIG. 6, it can be appreciated that the rail mounting assembly 150 can at least partially abut at least a portion of the bottom wall 142, such that at least a portion of the rail mounting assembly 150 can be supported by the bottom wall 142. Specifically, at least portions of the rail mounting braces 152, 154, the front cross brace 160, and the rear cross brace 164 can directly abut and be supported by the bottom wall 142. Further, and while still better seen in FIG. 6, it can be seen that the bottom wall 142 of the tub 14 does not define a uniform or flat bottom wall 142. Rather, in one example, the bottom wall 142 comprises a bottom edge portion 146 that is raised in height relative to the planar portions of the bottom wall 142 and generally extends at least partially around the periphery of the bottom wall 142. In one example, it is on the bottom edge portion 146 that at least portion of the rail mounting assembly 150 can be supported, such as the rail mounting braces 152, 154, and more specifically the downwardly depending flange 170, and at least portions of the front cross brace 160 and the rear cross brace 164.

Additionally, the front edge 168 can be seen as curving outwardly along and at least partially coextensive with a front edge of the tub 14, which would serve to prevent rearward motion of the rail mounting assembly 150 relative to the tub 14 and to the access opening. It can also be seen that the tub 14 defines at least two protrusions 148 that can cooperate with the rail mounting assembly 150. As illustrated herein, the at least two protrusions 148 are provided such that there is one protrusion 148 on each of the side walls 140, and that the protrusions 148 extend inwardly from the side wall 140 toward the treating chamber 16. In this way, the protrusions 148 can protrude inwardly through, so as to be partially received within the receiving openings 172. The receipt of the protrusions 148 within the receiving openings 172 can further aid in preventing undesired movement of components within the appliance by restricting movement of the rail mounting assembly 150 relative to the tub 14. Further, the protrusions 148 are positioned adjacent the rail assemblies 136, and in such a way that it appears that the protrusion 148 may at least partially provide support to the rail assembly 136.

Figure 6:
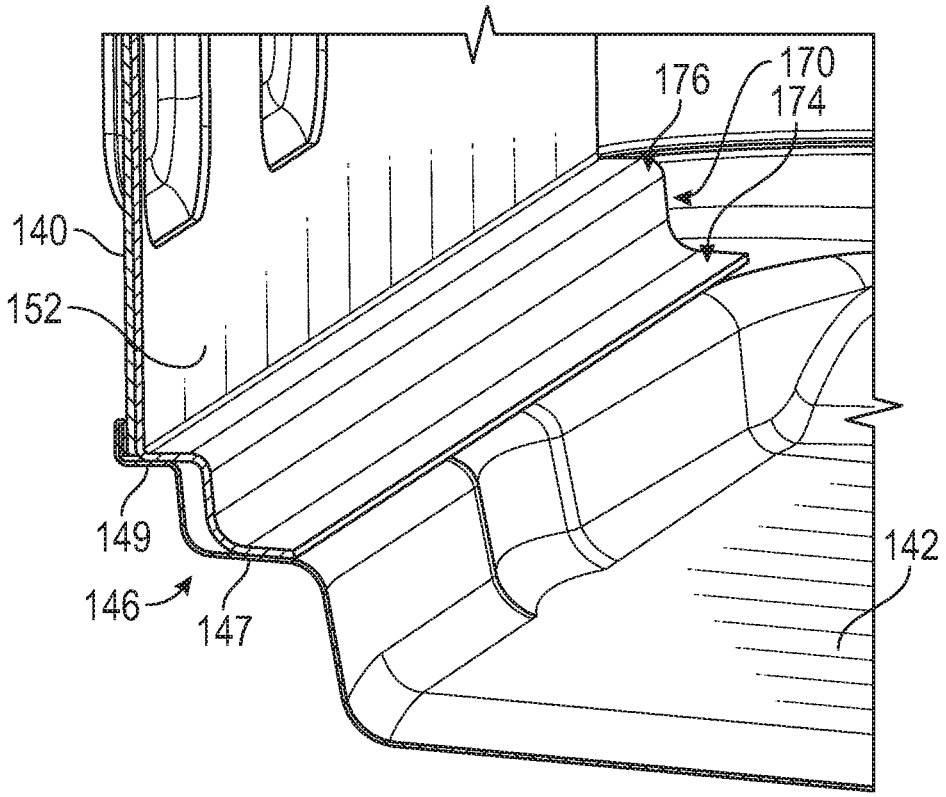
FIG. 6 is an enlarged cross-sectional view of a portion of the rail mounting assembly and the tub of FIG. 5 and taken along line VI-VI of FIG. 5.

Turning now to FIG. 6, the contact between the tub 14 and the rail mounting assembly 150, and specifically between the rail mounting brace 152 and the bottom wall 142 of the tub 14, is seen in greater detail. In this view, it can be better seen that the bottom edge portion 146 of the bottom wall 142 does not just simply define a raised rim of the bottom wall 142, but actually defines two distinct peripheral rims of the bottom edge portion 146 having different heights relative to one another, and such that the height of the bottom wall 142 effectively increases moving outwardly from the bottom wall 142 toward the side wall 140, and furthermore that the height increase occurs as two discrete steps up in height. In this way, the bottom edge portion 146 of the bottom wall 142 can now be thought of as comprising a first raised rim 147 having a first height relative to the flat portion of the bottom wall 142, and a second raised rim 149 having a second height relative to the flat portion of the bottom wall 142, the second height being greater than the first height. Further, the second raised rim 149 can be provided radially exteriorly of and outermost to the first raised rim 147, such as that the second raised rim 149 can at least partially surround the first raised rim 147.

Further, it can be seen that the downwardly depending flange 170 of the rail mounting brace 152 can be provided with a similar shape and contour profile to the bottom edge portion 146 so as to fit cooperatively with the bottom edge portion. Specifically, the downwardly depending flange 170 extends downwardly from the rail mounting brace 152 such that the downwardly depending flange 170 depends further downwardly from the rail mounting brace 152 moving inwardly from the bottom rail, toward the bottom wall 142. Further yet, the downwardly depending flange 170 can be thought of as defining two contours, 174, 176, which can be thought of together as forming overall the downwardly depending flange 170, and specifically such that the first contour 174 has a shape and profile that is generally complementary to the first raised rim 147, such that the first contour 174 can abut and be supported by at least a portion of the first raised rim 147, and the second contour 176 has a shape and profile that is generally complementary to the second raised rim 149, such that the second contour 176 has a shape and profile that is generally complementary to the second raised rim 149, such that the second contour 176 can abut and be supported by at least a portion of the second raised rim 149.

Figure 7:
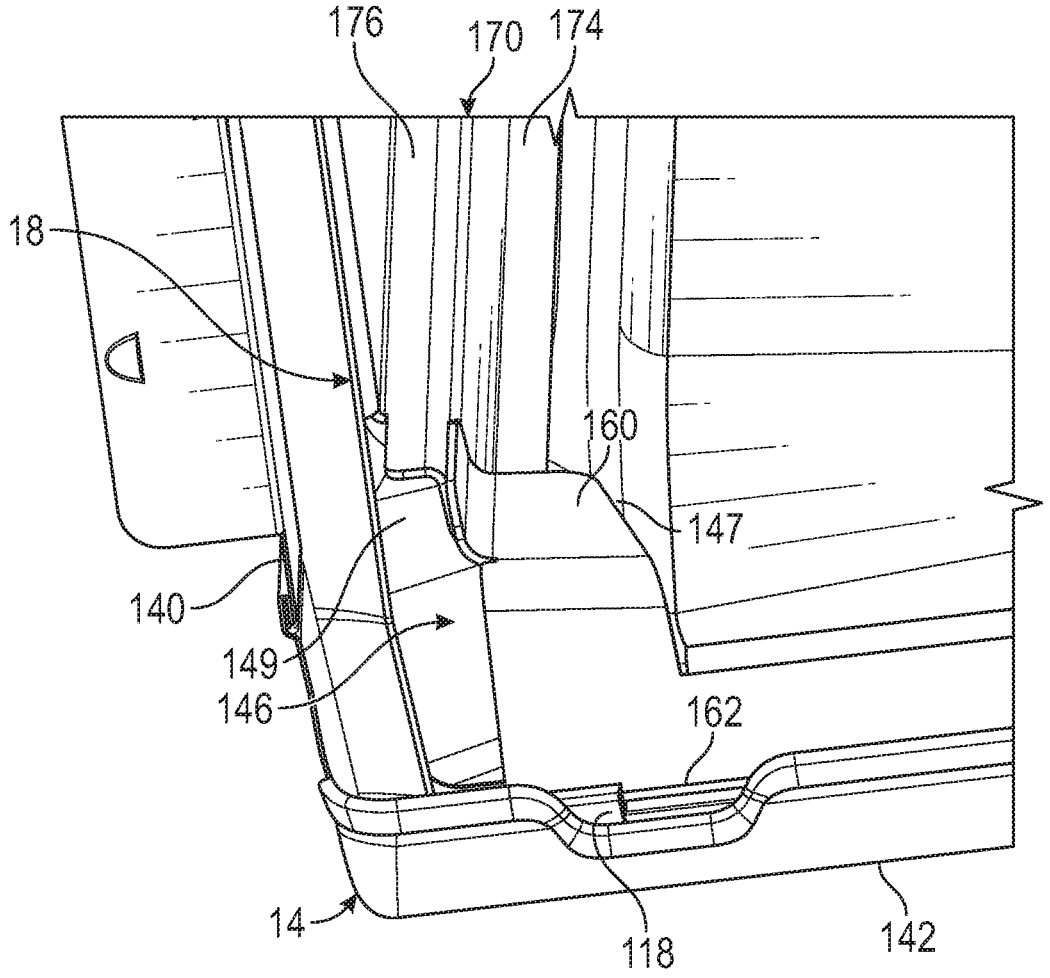
FIG. 7 is an enlarged perspective view of a portion of the rail mounting assembly and the tub of FIG. 5.

Turning now to FIG. 7, an engagement of a portion of the front cross brace 160 with a portion of the dishwasher 10 can be seen, and in a position adjacent the engagement between the first and second contours 174, 176 of the downwardly depending flange 170 and the first and second raised rims 147, 149 of the bottom edge portion 146. While it can be seen herein that the downwardly depending flange 170, and specifically the second contour 176, at least partially overlies the second raised rim 149, while the first contour 174 at least partially abuts and overlies the first raised rim 147, shown herein in a better view is a portion of the front cross brace 160. Specifically, and as previously described, the front edge 162 includes a portion of the front cross brace 160 that extends downwardly to terminate at and to define a front edge 162. Furthermore, the tub 14 further comprises a gasket retainer 118 that extends around at least a portion of the periphery of the open face 18, including the portion as shown herein. The front cross brace 160 is provided herein such that the front edge 162 is specifically retained by the gasket retainer 118 for prevention of unwanted movement of the rail mounting assembly 150 relative to the tub 14. For example, the engagement of the gasket retainer 118 and the front edge 162 of the front cross brace 160 can even comprise a force exerted, such that at least one of the gasket retainer 118 and the front edge 162 bears against the other, such as to form an interference fit between the two.

Figure 8:
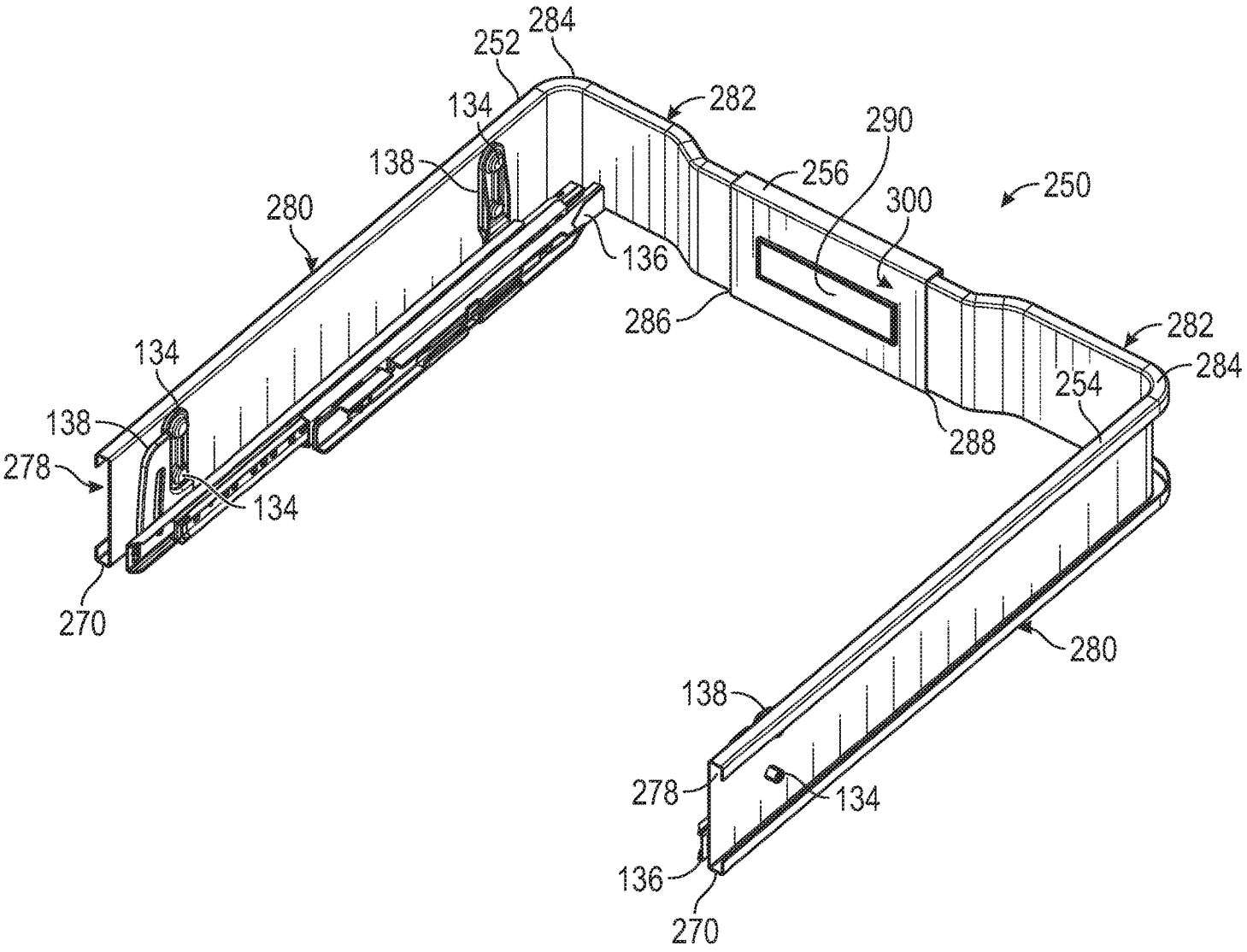
FIG. 8 is a perspective view of another example of a rail mounting assembly for use with the dishwasher of FIG. 1.

Referring now to FIG. 8, another example of a rail mounting assembly 250, a pair of rail mounting braces 252, 254, and a pair of rail assemblies 136 for use with the dishwasher 10 is shown. The rail mounting assembly 250, rail mounting braces 252, 254, and rail assemblies 136 are similar to the rail mounting assembly 150, rail mounting braces 152, 154, and rail assemblies 136, and share many of the same features and components as the rail mounting assembly 150, rail mounting braces 152, 154, and rail assemblies 136, but differ in some aspects, such as in the structure of and the coupling between the rail mounting braces 252, 254. Therefore, elements of the rail mounting assembly 250, rail mounting braces 252, 254, and rail assemblies 136 that are similar to those of the rail mounting assembly 150, rail mounting braces 152, 154, and rail assemblies 136 are identified with numerals increased by 100, with it being understood that the description of the like parts of the rail mounting assembly 150, rail mounting braces 152, 154, and rail assemblies 136 applies to the rail mounting assembly 250, rail mounting braces 252, 254, and rail assemblies 136, unless otherwise noted.

The rail mounting assembly 250 is similar to the rail mounting assembly 150 in that two rail mounting braces 252, 254 carry rail assemblies 136 for coupling within a tub 14 without providing additional holes in the tub 14, but differs from the rail mounting assembly 150 in that the rail mounting braces 252, 254 have a different structure and are coupled differently to one another, as well as to the tub 14. The rail mounting braces 252, 254 and corresponding paired rail assemblies 136 are still spaced from one another so as to be positioned adjacent opposite side walls 140 and are provided as flipped or mirror images to one another. The mounting of the rail assemblies 136 to the rail mounting braces 252, 254 can be provided in the same manner, such that at least one mounting bracket 138 couples each rail assembly 136 with one of the rail mounting braces 252, 254, and such as by the use of at least one fastening element 134 that extends through the rail mounting brace 252, 254.

The rail mounting assembly 250 differs from the rail mounting assembly 150 in that the rail mounting assembly 250, instead of being retained primarily by engagement with the rails 36 of the upper dish rack 32, the rail mounting assembly 250 is instead retained primarily by outwardly biased engagement with the tub 14, and also that the rail mounting braces 252, 254 have a different structure than those of the rail mounting assembly 150. Turning first to the rail mounting braces 252, 254, each rail mounting brace 252, 254 comprises a first portion 280 extending along at least a portion of one of the side walls 140 and a second portion 282 extending along at least a portion of the rear wall 144. In this way, the first portions 280 can be thought of as side portions 280, while the second portions 282 can be thought of as rear portions 282. The side portions 280 can each be coupled to one of the rear portions 282 by a corner portion 284. The side portions 280 can each further extend to and terminate at an open end 278, provided at the end of the side portion 280 that is opposite the corner portion 284. In one aspect, the open end 278 can remain. Alternatively, the open end 278 can be provided with any suitable type of end cap or cover for aesthetic purposes.

The rail mounting braces 252, 254 each further comprise a bottom surface 270, which can be provided in contact with at least a portion of the bottom wall 142, such as the bottom edge portion 146, and can be thought of analogous to the downwardly depending flange 170 in some ways. While the rail mounting braces 252, 254 are not illustrated herein as including as many dedicated engagement features as the rail mounting assembly 150 included, it will be understood that the aspects of the disclosure are still applicable. For example, the rail mounting braces 252, 254 can include an opening or at least an indentation feature for engagement with the protrusions 148 of the tub 14. In addition, it should be appreciated that the entire profile and perimeter defined by the rail mounting assembly 250 can be selected so as to be complementary with the perimeter of the tub 14 for providing engagement functions for the rail mounting assembly 250. Further, while the rail mounting assembly 250 is not illustrated herein as including the front cross brace 160, it will be understood that the front cross brace 160 could be included with the rail mounting assembly 250 and having the same structure and properties as described previously. In such an example, the front cross brace 160 could extend between the side portions 280 at any suitable position along the side portions 280, such as, by way of non-limiting example, near or adjacent to the open ends 278 for providing the most additional stability of the rail mounting assembly 250.

The rail mounting braces 252, 254 are retained within the tub 14 by way of engagement with one another to provide outwardly biasing force. To achieve this, the rail mounting braces 252, 254 can be movably coupled to one another, and can further by biased outwardly from one another. In one example, the rail mounting braces 252, 254 are movably coupled to one another by way of telescoping relative movement. A cross brace 256 can be included in the rail mounting assembly 250 and provided between the rail mounting braces 252, 254 in order to operably couple the rail mounting braces 252, 254. In this way, the cross brace 256 can also be thought of as a coupling element or a coupling housing. As the rail mounting braces 252, 254 are retained within the tub 14 by outwardly biasing force, a biasing assembly 300 is included with the rail mounting assembly 250 to provide the outwardly biasing force and to operably couple with the rail mounting braces 252, 254. Since the cross brace 256 already serves to operably couple the rail mounting braces 252, 254 for movement relative to one another, the cross brace 256 can further include, as well as comprise at least a portion of, the biasing assembly 300 for operable coupling of the biasing assembly 300 with the rail mounting braces 252, 254. Thus, the cross brace 256 can be further thought of as a coupling element and a biasing element, as well as a housing for these assemblies, and configured to apply force from the biasing assembly to bias the rail mounting braces 252, 254 outwardly and away from one another, and specifically to bias the rear portions 282 of the rail mounting braces 252, 254 laterally outwardly from one another. The cross brace 256 can further include a removable cover 290. In some aspects, the cover 290 is provided as an aesthetic element, such as for providing a logo. However, in other aspects, the cover 290 can form a portion of the biasing assembly and be operably coupled thereto. In further aspects, the cover 290 may not be desired for either of these purposes.

Specifically, each rail mounting brace 252, 254 is at least partially telescopingly received within the cross brace 256, such that the cross brace 256 defines a first open end 286 for telescopingly receiving the first rail mounting brace 252, and the cross brace 256 further defines a second open end 288 for telescopingly receiving the second rail mounting brace 254. In one example, the rail mounting braces 252, 254 are telescopingly received by the cross brace 256 only up until the point that the rail mounting braces 252, 254 abut one another within the cross brace 256, preventing further inward movement. However, it is also contemplated that the rail mounting braces 252, 254 could further telescopingly move relative to one another, such that one of the rail mounting braces 252, 254 can be telescopingly received within the other once they are brought into contact with one another within the cross brace 256. Further yet, in such an example that the rail mounting braces 252, 254 are telescopingly received, one within the other, it is also contemplated that the cross brace 256 could then be eliminated entirely and the coupling of the rail mounting braces 252, 254 would simply comprise one of the rail mounting braces 252, 254 telescopingly received within the other.

Figure 9:
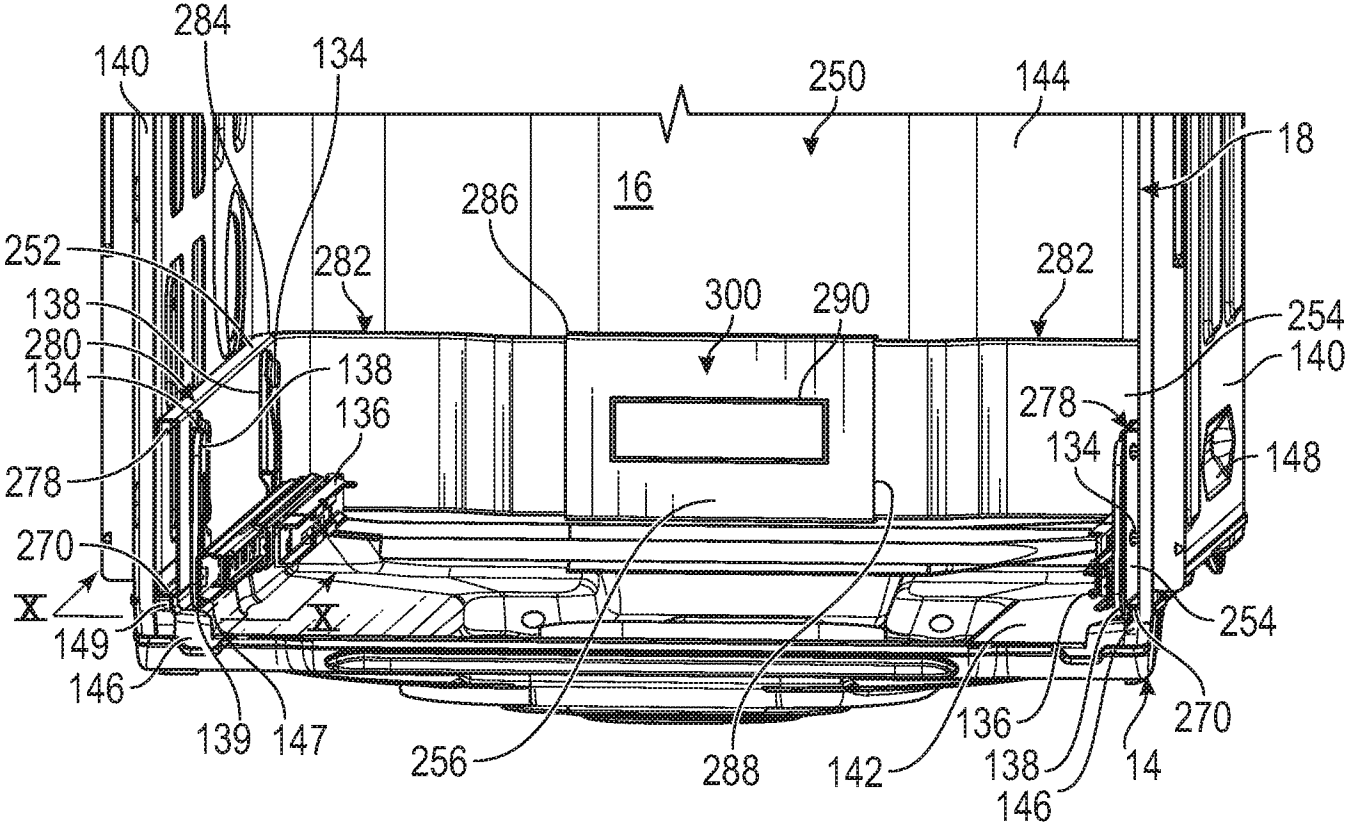
FIG. 9 is a perspective view of the rail mounting assembly of FIG. 8 provided within and coupled with the tub of the dishwasher of FIG. 1.

Turning now to FIG. 9, the rail mounting assembly 250 is shown in an installed position within and coupled to the tub 14 for a better view of the coupling and engagement between the rail mounting assembly 250 and the tub 14. While no receiving opening 172 was illustrated within the rail mounting assembly 250, the protrusion 148 can be seen with the tub 14, and it is contemplated that the rail mounting braces 252, 254 could include some sort of detent or structural feature for engaging with the protrusion 148. Further, the engagement between the rail mounting assembly 250 and the bottom wall 142 of the tub 14 is illustrated. The rail mounting braces 252, 254, rather than including a downwardly depending flange or skirt as in the rail mounting assembly 150, define a bottom surface 270, which can be substantially flat. As the bottom surface 270 is not contoured to fit along with the contours of the first and second raised rims 147, 149, the bottom surface 270 can instead be positioned to rest entirely, or substantially entirely, on the second, or outermost raised rim 149, such that the rail mounting assembly 250 abuts and is supported by the second raised rim 149 of the tub bottom wall 142.

Figure 10:
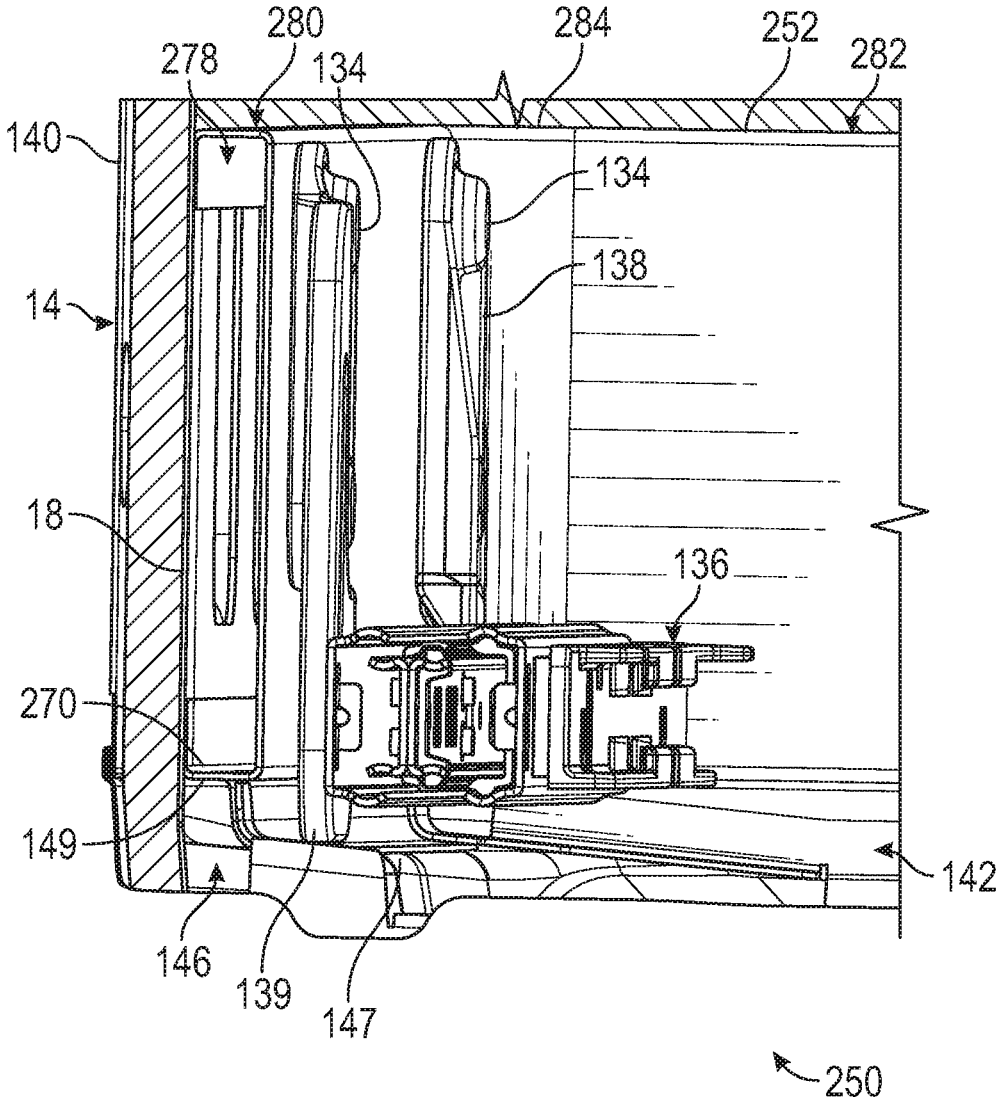
FIG. 10 is an enlarged cross-sectional view of a portion of the rail mounting assembly and the tub of FIG. 9 and taken along line X-X of FIG. 9.

Turning now to FIG. 10, while the bottom surface 270 is flat and does not overhang or overlie the bottom wall 142 beyond the second raised rim 149, it can be better seen in this view that the mounting brackets 138 that are coupled to the rail mounting braces 252, 254 further comprise a downwardly depending portion 139 that extends below a lowermost extent of the bottom surface 270. Since the bottom surface 270 rests on the second raised rim 149, with the mounting bracket 138 protruding both inwardly and downwardly from the rail mounting braces 252, 254, the mounting bracket 138, and in particular the downwardly depending portion 139, can be thought of and seen as extending over and overlying the first raised rim 149. Further, it is contemplated that, in one example, the mounting bracket 138 and the downwardly depending portion 139 could extend from the rail mounting braces 252, 254 such that the bottom surface 270 overlies and rests on the second raised rim 149, while the mounting bracket 138, and in particular the downwardly depending portion 139, can extend to the extent that the downwardly depending portion 139 extends out over to overlie the first raised rim 147, as shown, but could even further protrude downwardly to the extent that the downwardly depending portion 139 can abut the first raised rim 147, so as to be at least partially supported by the tub bottom wall 142.

Figure 11:
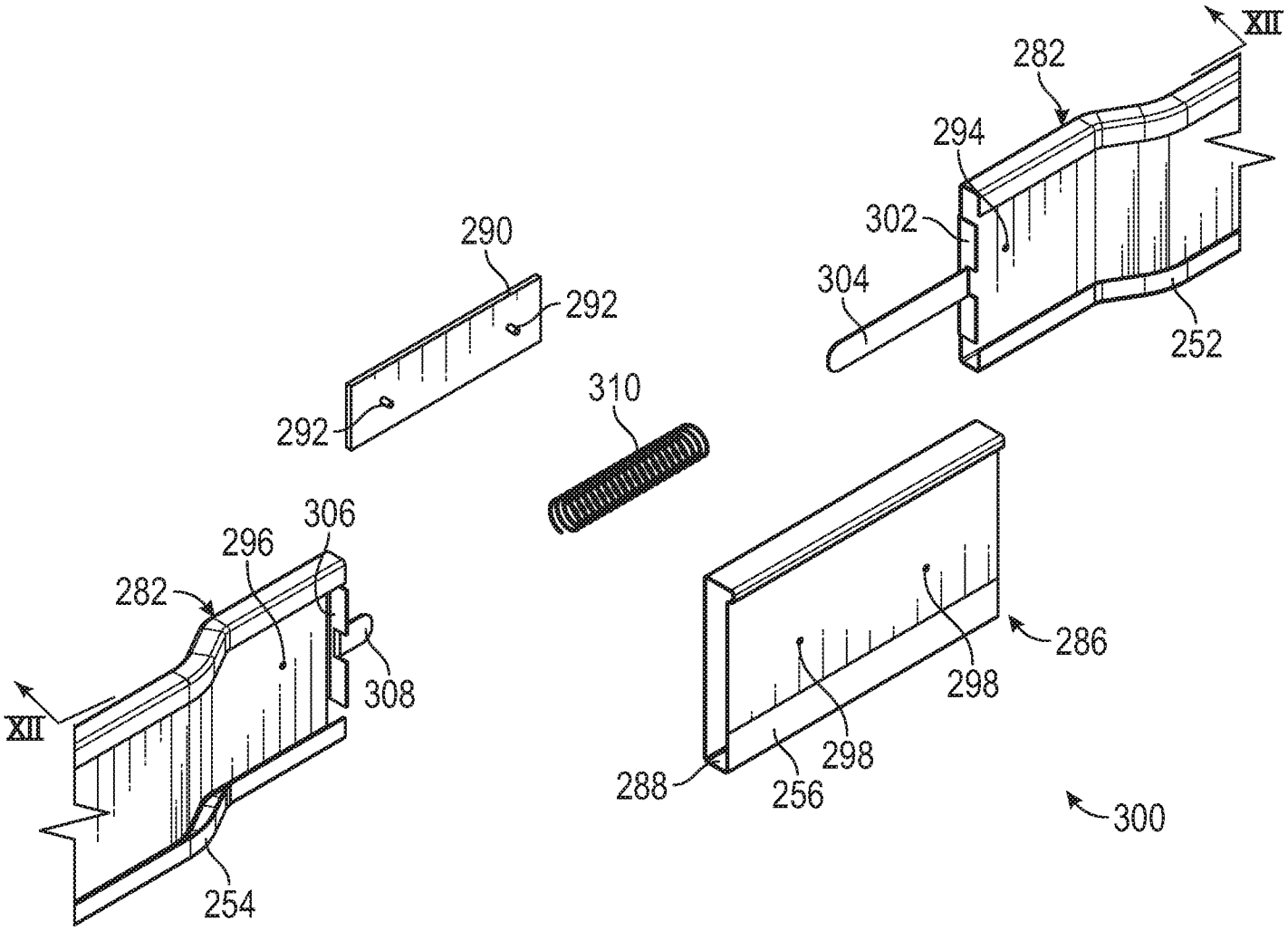
FIG. 11 is an exploded perspective view of an example of a biasing assembly for use with the rail mounting assembly of FIG. 8.

Turning now to FIG. 11, an example of a biasing assembly 300 that can be provided with the rail mounting assembly 250, and specifically within the cross brace 256, is shown in an exploded view. The removable cover 290, which can be specifically removably coupled to a front of the cross brace 256, is shown as further including a set of pins 292 that can operably couple with the biasing assembly 300. Regardless of whether or not the removable cover 290 is operably coupled with any of the specific examples of the biasing assemblies, it will be understood that the removable cover 290 is removably coupled to the cross brace 256 in any suitable manner, non-limiting examples of which include as a snap-in cover or cap. Further, the cross brace 256 is further shown as including a pair of openings 298 which can couple with the pins 292. Similar openings are provided on the front of the cross brace 256, but are not seen as they are covered when the removable cover 290 is in place.

The first rail mounting brace 252 is shown as further including an opening 294 at its front, the opening 294 configured to receive one of the pins 292. The first rail mounting brace 252 further comprises a rod 304 extending inwardly from the first rail mounting brace 252 and toward the second rail mounting brace 254. At the junction of the rod 304 and the body of the first rail mounting brace 252, a partition, which can be thought of as illustrated herein as a deflecting wall 302 preventing further movement into the first rail mounting brace 252 from the rod 304.

The second rail mounting brace 254 is shown as further including an opening 296 at its front, the opening 296 configured to receive one of the pins 292. The second rail mounting brace 254 further comprises a flange 308 extending inwardly from the second rail mounting brace 254 and toward the first rail mounting brace 252. The flange 308 is shaped substantially the same as the rod 304, but is shorter in length. At the junction of the flange 308 and the body of the second rail mounting brace 254, a partition, which can be thought of as illustrated herein as a second deflecting wall 306 to prevent further movement into the second rail mounting brace 254 from the flange 308.

A biasing element 310, illustrated herein as a spring 310 is also included and positioned between the rail mounting braces 252, 254 and is configured to bias the rail mounting braces 252, 254, and specifically the second or rear portions 282, laterally outwardly away from one another, and in turn against the side walls 140. The biasing element 310, in cooperation with the biasing assembly 100 as a whole, is configured to automatically bias the biasing assembly 300, and therefore, in turn, also the rail mounting assembly 250, outwardly from a non-extended position to an extended position. In one example, it is contemplated that the rail mounting assemblies 150, 250, 750 and the biasing assemblies 300, 400, 500, 600 described herein with the present disclosure are intended to be maintained in the non-extended position for easy insertion into the tub 14 prior to installation, and then can be operated to allow biasing to the extended position, as shown previously and corresponding to the normal configuration of the rail mounting assembly 150, 250, 750, once it is in place within the tub 14.

With respect to the exploded view as shown, it will be understood that, in the assembled condition of the biasing assembly 300, the spring 310 is provided about both the rod 304 and the flange 308, such that both the rod 304 and the flange 308 are at least partially received within the spring 310. In this configuration, the rod 304 and the flange 308 are positioned so as to abut and confront one another, being retained within the spring 310, and further such that relative movement can occur between the rod 304 and the flange 308. Further, in the assembled condition, with the rail mounting braces 252, 254 moved together and carrying the spring, the cross brace 256 would enclose both the ends of the rail mounting braces 252, 254, the spring 310, the flange 308, and the rod 304. Furthermore, the removable cover 290 can be coupled to the cross brace 256.

Figure 12:
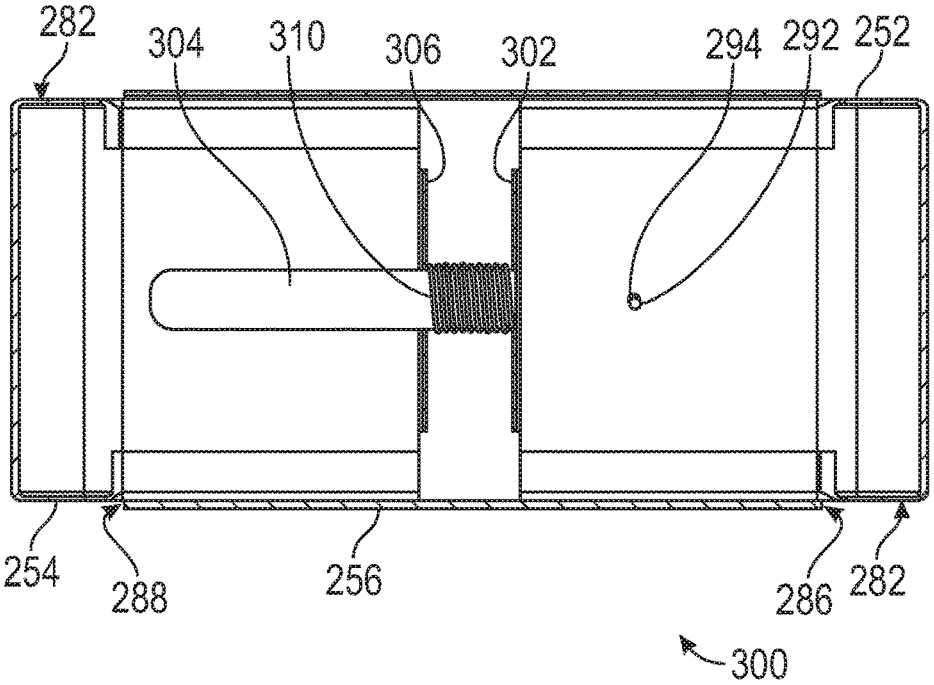
FIG. 12 is a cross-sectional view of the biasing assembly of FIG. 11, with the biasing assembly in an unextended position and taken from a rear of the biasing assembly, along line XII-XII of FIG. 11.

Turning now to FIG. 12, the biasing assembly 300 is seen in an un-extended position, which would correspond to an initial start position of the biasing assembly 300, prior to being installed within a dishwasher 10. In the un-extended position as shown, the rail mounting braces 252, 254 are moved inwardly relative to one another. Both the rod 304 and the flange 308 are still in confronting arrangement and still both received within the spring 310. In this view, the flange 308 cannot be seen as it is provided behind the rod 304. While it can be seen that the rod 304 is movable past the second deflecting wall 306, such as by being at least partially received within the opening in the second deflecting wall 306, and for movement into the interior of the second rail mounting brace 254, the spring 310 is prevented from moving past the second deflecting wall 306.

In addition, the spring 310 is likewise prevented from moving past the deflecting wall 302, such that the spring 310 is instead compressed between the deflecting walls 302, 306 as the rail mounting braces 252, 254 are moved together. When the biasing assembly 300 occupies this un-extended position, the force of the spring 310 would bias the components away from the un-extended position, into the extended position, unless the force of the spring 310 is overcome. In this case, when the biasing assembly 300 is in the un-extended position, the openings 294, 296 on the rail mounting braces 252, 254 are brought into alignment with the openings on the cross brace 256, such that the removable cover 290 is inserted onto the cross brace 256, the pins 292 extending through the cross brace 256 and into the openings 294, 296 on the rail mounting braces 252, 254, preventing movement of the rail mounting braces 252, 254 away from one another and maintaining the biasing assembly 300 in the un-extended position until the removable cover 290 is removed.

Figure 13:
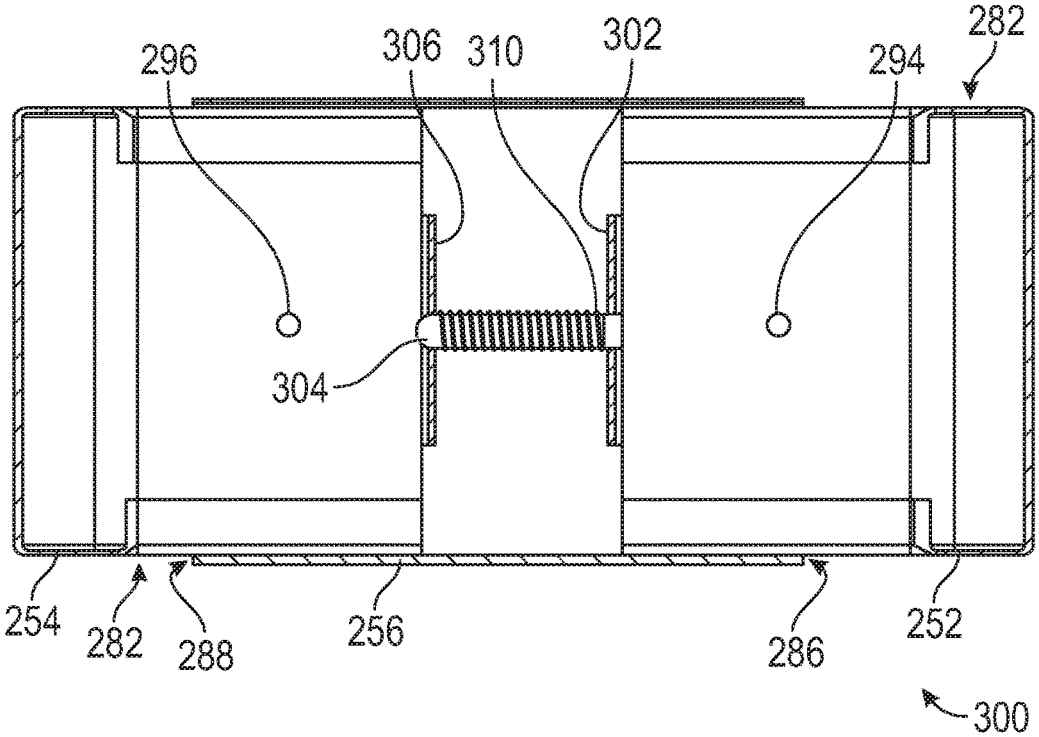
FIG. 13 is a cross-sectional view of the biasing assembly of FIG. 12, and taken from the same view of FIG. 12 and along line XII-XII of FIG. 11, with the biasing assembly in an extended position.

Referring now to FIG. 13, the biasing assembly 300 is in the extended position, with the pins 292 not received within the openings 294, 296 and not restraining the rail mounting braces 252, 254. The spring 310, not held in a compressed condition, extends to the extended length, biasing the second rail mounting brace 254 away from the first rail mounting brace 252. With the biasing assembly 300 in the extended position, the removable cover 290 can be replaced onto the cross brace 256 and will no longer align with the openings 294, 296. Rather, it is contemplated that, when the removable cover 290 is inserted to the cross brace 256 when the biasing assembly 300 is in the extended position, the pins 292 instead protrude into the cross brace 256 and, in particular, within the length of the rod 304, such as that the pins 292 in the illustrated position protrude just inwardly of the deflecting walls 302, 306. In this way, the pins 292 now serve to prevent the rail mounting braces 252, 254 from moving toward one another, further aiding in maintaining the rail mounting braces 252, 254 in remaining firmly biased in place within the tub 14. In this way, the pins 292 and the removable cover 290 can act to comprise a locking mechanism that prevents the rail mounting braces 252, 254, and in particular the rear portions 282 thereof, from moving toward one another.

Figure 14:
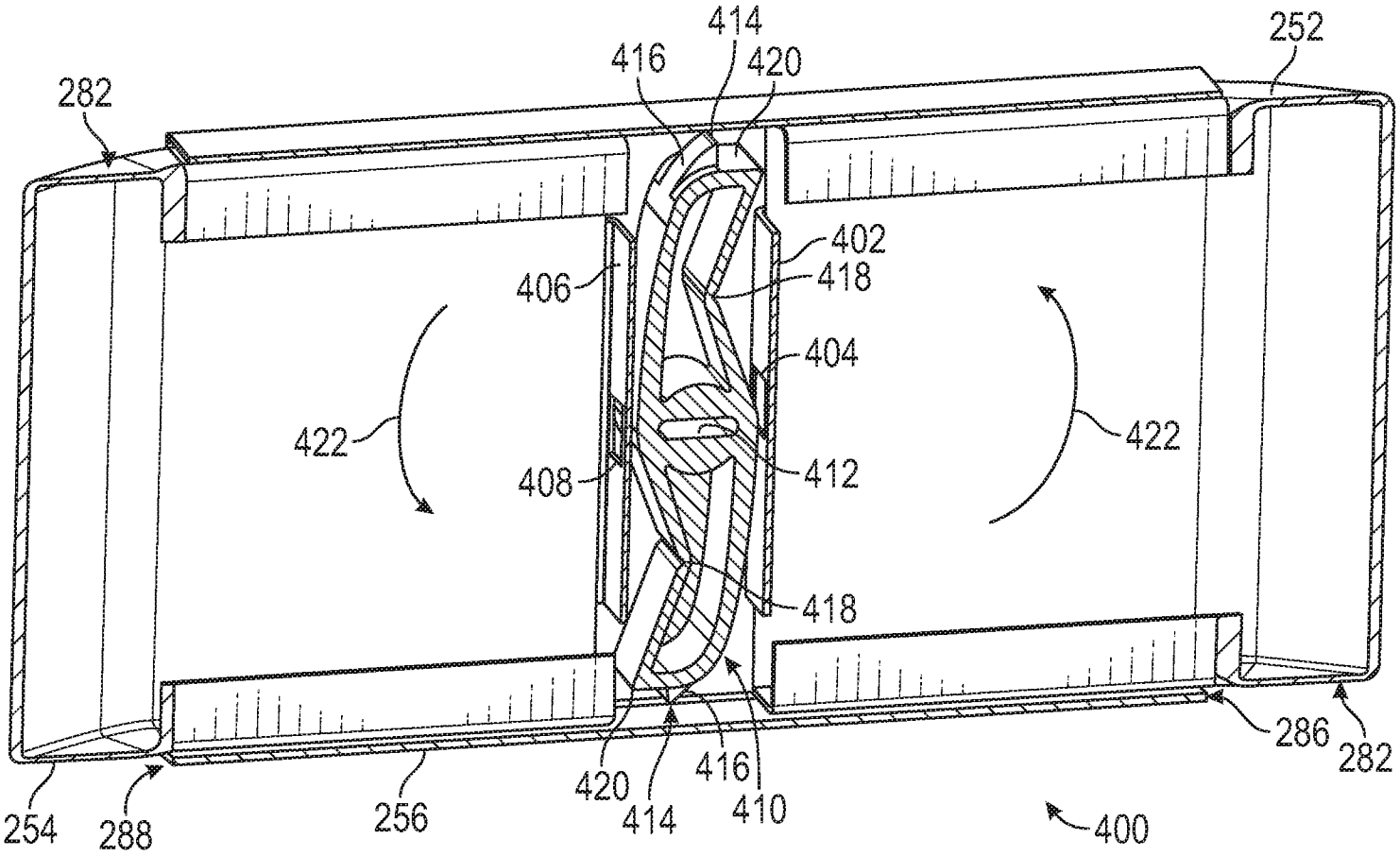
FIG. 14 is a perspective cross-sectional view of another example of a biasing assembly for use with the rail mounting assembly of FIG. 8, with the biasing assembly in an unextended position and taken from the rear of the biasing assembly, along line XIV-XIV of FIG. 16.

Referring now to FIG. 14, another example of a biasing assembly 400 that can be provided with the rail mounting assembly 250, is shown. The biasing assembly 400 is similar to the biasing assembly 300 and shares many of the same features and components as the biasing assembly 300, but differs in some aspects, such as in the structure and actuation of the biasing element 410. Therefore, elements of the biasing assembly 400 that are similar to those of the biasing assembly 300 are identified with numerals increased by 100, with it being understood that the description of the like parts of the biasing assembly 300 applies to the biasing assembly 400, unless otherwise noted.

The biasing assembly 400 is similar to the biasing assembly 300 in application of the biasing force, but differs in the structure and actuation of the biasing element 410. The biasing assembly 400 is illustrated herein in the un-extended position, and with the rear cover of the cross brace 256 removed by the cross-sectional view. In the un-extended position, the rail mounting braces 252, 254 are positioned moved inwardly toward one another relative to the use position of the rail mounting assembly 250. Each of the rail mounting braces 252, 254 include one of the deflecting walls 402, 406, respectively, with the deflecting walls 402, 406 each further including a retaining opening 404, 408, respectively.

The biasing element 410 is illustrated herein as a rotatable locking element 410, such as a rotatable locking cam, and is shown in the un-extended position. The biasing element 410 comprises an actuator 412, provided herein as an actuation opening 412, and further defining an axis of rotation for the biasing element 410. In the un-extended position as shown, the actuation opening 412 is provided in a generally horizontal position. The biasing element 410 includes detents 414 provided at its opposing ends. Each of the detents 414 includes a ramped surface 416. On the opposite side of the detent 414 from the ramped surface 416, each end includes a catch surface 420. Further, on the opposite side of the biasing element 410 body from the ramped surface 416, each end of the biasing element 410 further includes a deflectable portion 418, which can be thought of as a line of weakness that is provided within the biasing element 410. The arrows 422 correspond to an actuation direction for actuating the biasing assembly 400.

Figure 15:
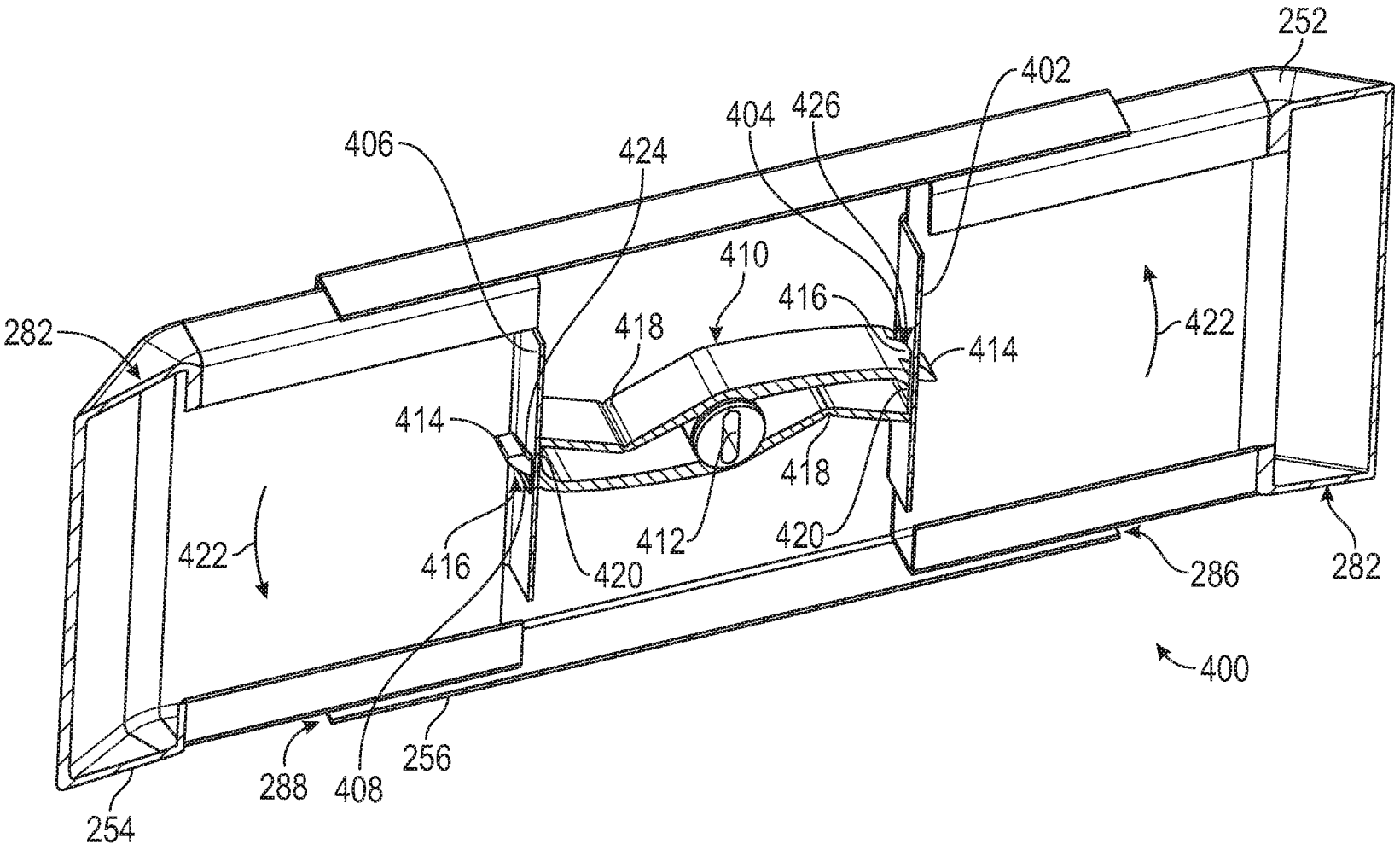
FIG. 15 is a perspective cross-sectional view of the biasing assembly of FIG. 14, and taken from the same cross-section of FIG. 14 and along line XIV-XIV of FIG. 16, with the biasing assembly in an extended position.

Referring now to FIG. 15, the biasing assembly 400 is shown in the extended position. In the extended position, the biasing element 410 is rotated, such as by, for example, 90° relative to the un-extended position, pushing the rail mounting braces 252, 254 outwardly away from one another by exerting its biasing force against the deflecting walls 402, 406 as the biasing element 410 rotated to the extended position. In the extended position, the biasing element 410 is provided with the body in a generally horizontal configuration, but with the actuation opening 412 provided in a generally vertical position. The detents 414 are received within the retaining openings 404, 408 such that, at one end, the detent 414 and the catch surface 420 bear against an upper edge 424 of the retaining opening 408, while, at the other end of the biasing element 410, the detent 414 is received within the retaining opening 404 such that the detent and the catch surface 420 bear against the retaining opening 404, in a direction opposite from the upper edge 426. The arrows 422 correspond to an actuation direction for actuating the biasing assembly 400 away from the extended position.

Turning now to the operation of the biasing assembly 400, when the biasing element 410 is actuated from the un-extended position to the extended position, the biasing element 410 rotates in the direction of the arrows 422. Such actuation can occur when a user, for example, inserts a key or other actuator into the actuation opening 412 to rotation the actuation opening 412 to the next position. As the biasing element 410 rotates toward the extended position in the direction of the arrows 422, the biasing element 410 bears against and outwardly biases the deflecting walls 402, 406 away from each other. As rotation continues, the ramped surfaces 416 are brought into contact with the deflecting walls 402, 406 until the detent 414 reaches the retaining opening 404, 408. Once the ramped surfaces 416 have passed the edge of the retaining openings 404, 408, the detents 414 will abruptly pop into place into the retaining openings 404, 408.

The abrupt edge of the detents 414 and the catch surfaces 420 prevent the biasing element 410 from being rotated out of engagement with the retaining openings 404, 408 in the opposite direction of the arrows 422, thus retaining the biasing element 410 within the retaining openings 404, 408 and in the extended position. In this way, the biasing element 410 can act to comprise a locking mechanism that prevents the rail mounting braces 252, 254, and in particular the rear portions 282 thereof, from moving toward one another.

In order to return the biasing element 410 and the biasing assembly 400 to the un-extended position, the biasing element 410 must again be manually actuated to leave the extended position and return to the un-extended position. For example, the user can again turn the actuation key to rotate the actuation opening 412, rotating the biasing element 410 again in the direction of the arrows 422. As the ramped surfaces 416 come into contact with the edges of the retaining openings 404, 408, the gradual angle of the ramped surfaces 416, and in combination with the pressure on the biasing element 410 causing the biasing element 410 to collapse at the deflectable portions 418, allows the biasing element 410 to be deflected enough that the detents 414 can rotate out of the retaining openings 404, 408 and are permitted to return to the un-extended position of the biasing element 410.

Figure 16:
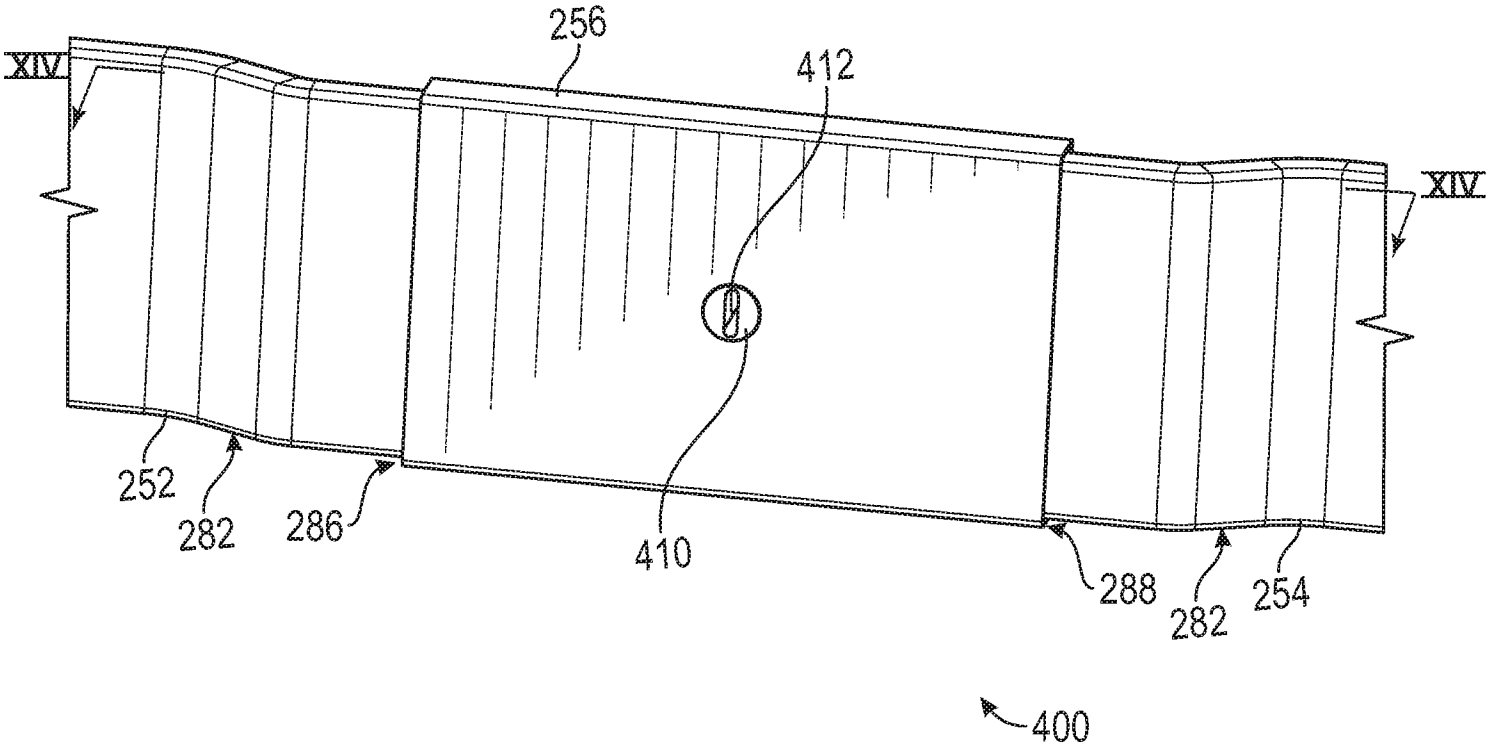
FIG. 16 is a front perspective view of the biasing assembly of FIG. 15, with the biasing assembly in the extended position and having an actuating element.

FIG. 16 shows the visual appearance of the biasing assembly 400 to the user when the rail mounting assembly 250 is in its normal, use position. As illustrated herein, the rail mounting braces 252, 254 are in the extended position, and the vertical position of the actuation opening 412 indicates that the biasing element 410 is in the extended position. In order to operate the biasing assembly 400, the user can use a provided key to insert into the actuation opening 412 and rotate accordingly.

Figure 17:
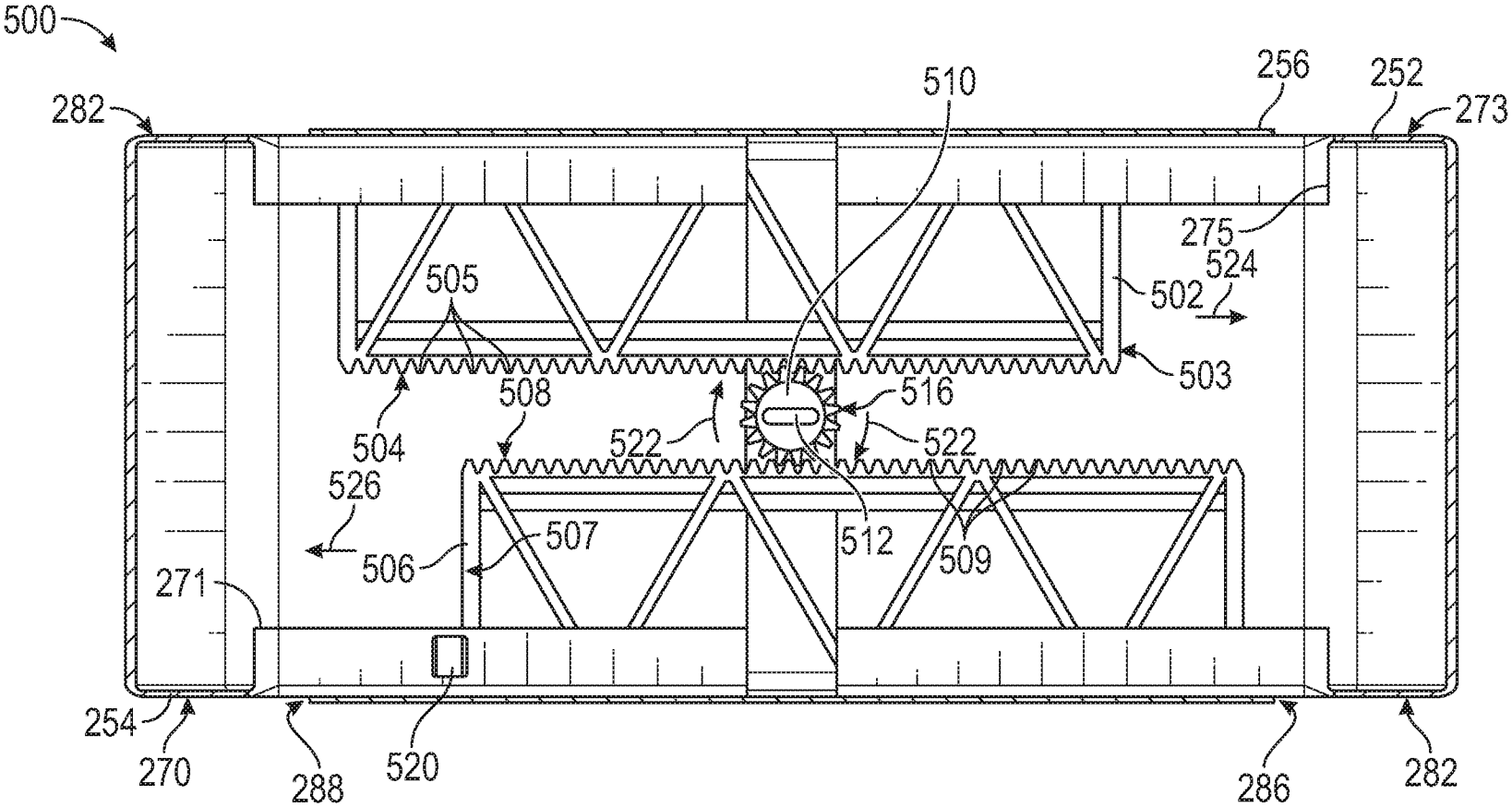
FIG. 17 is a cross-sectional view of another example of a biasing assembly for use with the rail mounting assembly of FIG. 8, with the biasing assembly in an unextended position and taken from the rear of the biasing assembly, along line XVII-XVII of FIG. 19.

Referring now to FIG. 17, another example of a biasing assembly 500 that can be provided with the rail mounting assembly 250, is shown. The biasing assembly 500 is similar to the biasing assembly 400 and shares many of the same features and components as the biasing assembly 400, but differs in some aspects, such as in the structure and actuation of the biasing element 510. Therefore, elements of the biasing assembly 500 that are similar to those of the biasing assembly 400 are identified with numerals increased by 100, with it being understood that the description of the like parts of the biasing assembly 400 applies to the biasing assembly 500, unless otherwise noted.

The biasing assembly 500 is similar to the biasing assembly 400 in application of the actuating force, but differs in the structure and operation of the biasing element 510. The biasing assembly 500 is shown herein in the un-extended position with the rail mounting braces 252, 254 moved inwardly toward one another relative to the use position of the rail mounting assembly 250. Each of the rail mounting braces 252, 254 includes an associated rack 502, 506, respectively. The racks 502, 506 each define a toothed inner surface 504, 508 defining a plurality of teeth 505, 509, such that the overall biasing assembly 500 is provided as a rack and pinion assembly.

A leading surface 503, 507 for each of the racks 502, 506 is defined by the direction in which the racks 502, 506, and thus also the rail mounting braces 252, 254, move when the biasing assembly 500 is actuated. As shown with the rack 506, the rack 506 can be configured to be actuated in the direction of the arrow 526, bringing the leading surface 507 into contact with a catch surface 520 to prevent further movement of the leading surface 507 past the catch surface 520. The catch surface 520 can protrude inwardly toward the interior of the rail mounting brace 254 from a lip 271 that extends upwardly from the bottom surface 270. While a catch surface is not illustrated with the rack 502 and the rail mounting brace 252, it will be understood that a catch surface for the rack 502 can be implemented in a corresponding manner, such that the rail mounting brace 252 can have a lip 275 extending downwardly from an upper surface 273, wherein the catch surface can protrude inwardly toward the interior of the rail mounting brace 252 from the lip 275.

A biasing element 510, illustrated herein as a pinion 510 and defining a toothed outer surface 516 can include an actuation opening 512 for manual actuation by a user in the direction of the arrows 522. The pinion 510 is in toothed or enmeshed engagement with both toothed surfaces 504, 508 of the racks 502, 506, such that rotation of the pinion 510 results in corresponding outward movement of the racks 502, 506 and thus also the rail mounting braces 252, 254. Specifically, rotation of the pinion 510 in the direction of the arrows 522 causes translational movement of the rack 502 in the direction of the arrow 524, while also causing translational movement of the rack 506 in the direction of the arrow 526, opposite the first.

Figure 18:
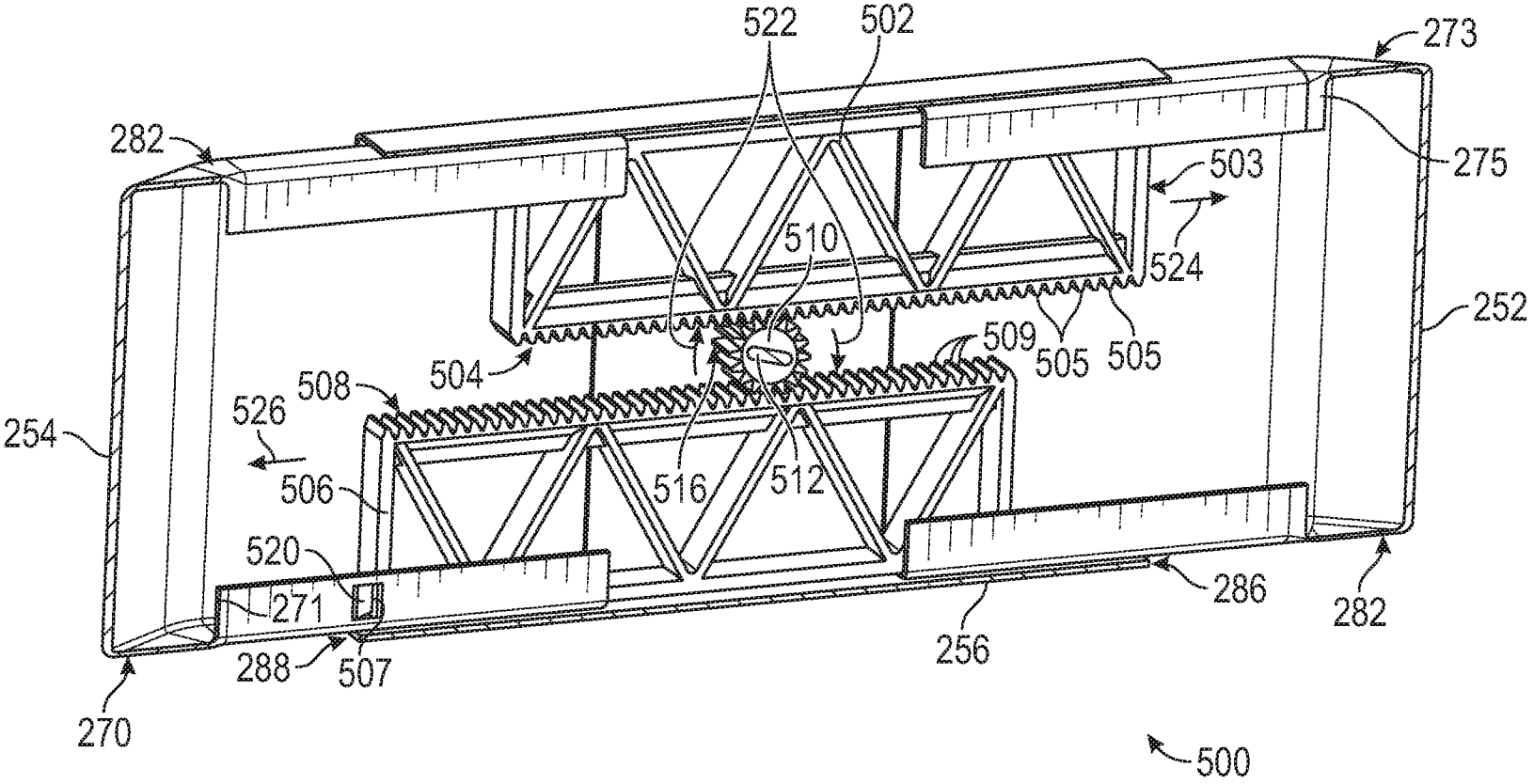
FIG. 18 is a perspective cross-sectional view of the biasing assembly of FIG. 17, and taken from the same cross-section of FIG. 17 and along line XVII-XVII of FIG. 19, with the biasing assembly in an extended position.

Referring now to FIG. 18, the biasing assembly 500 is in the extended position wherein the racks 502, 506 and the rail mounting braces 252, 254 are moved away from one another. Specifically, rotation of an actuator, such as a key, when inserted in the actuation opening 512, rotates the pinion in the direction of the arrows 522. As the pinion rotates, the engagement of its toothed surface 516 with the toothed surfaces 504, 508 of the racks 502, 506 causes the racks 502, 506 to move outwardly away from each other and away from the pinion 510, and in the direction of the arrows 524, 526, respectively.

Figure 19:
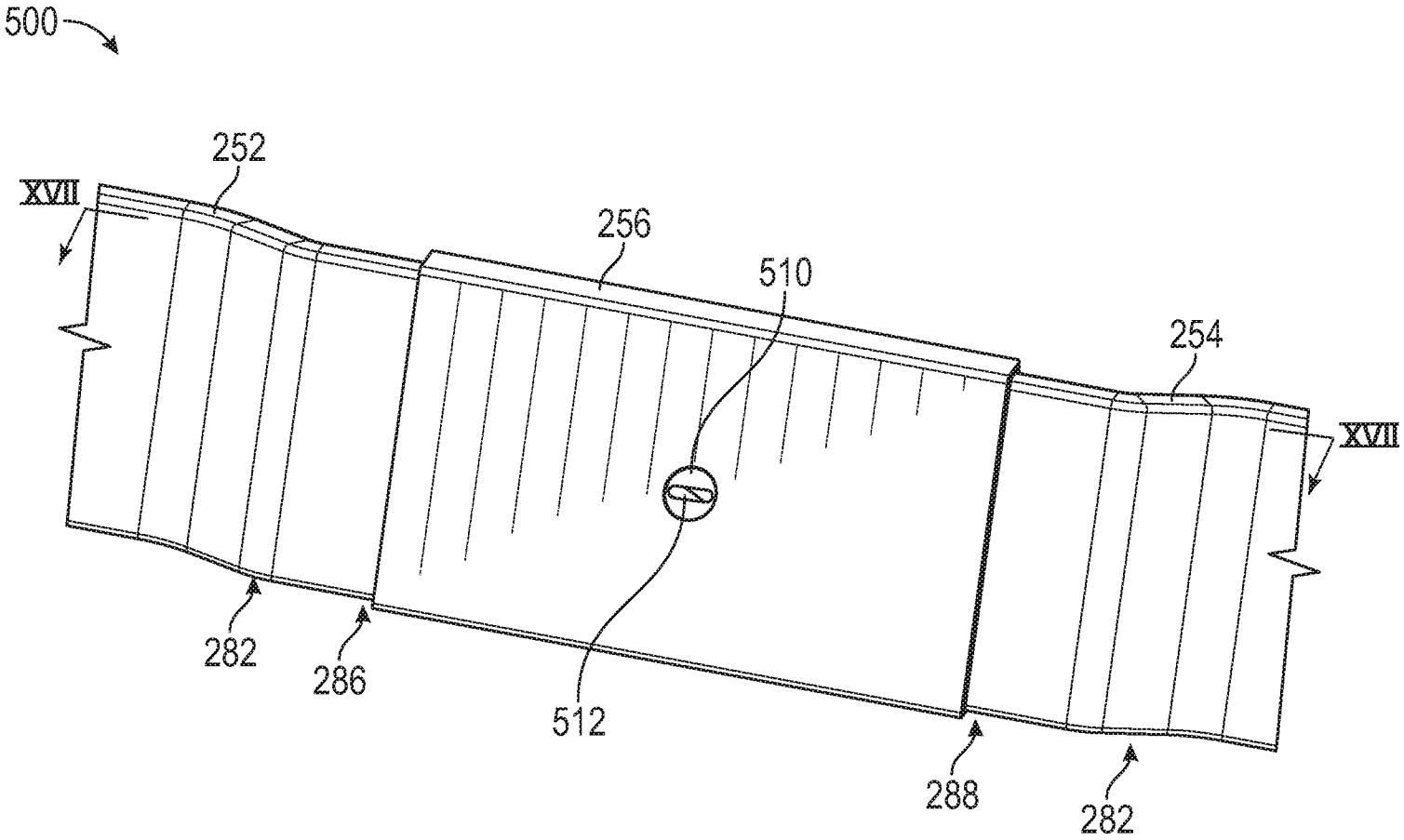
FIG. 19 is a front perspective view of the biasing assembly of FIG. 18, with the biasing assembly in the extended position and having an actuating element.

FIG. 19 shows the visual appearance of the biasing assembly 500 to the user when the rail mounting assembly 250 is in its normal, use position. As illustrated herein, the rail mounting braces 252, 254 are in the extended position, and the actuation opening 512 is accessible by the user for operation accordingly. In order to operate the biasing assembly 500, the user can use a provided key to insert into the actuation opening 512 and rotate accordingly.

Figure 20:
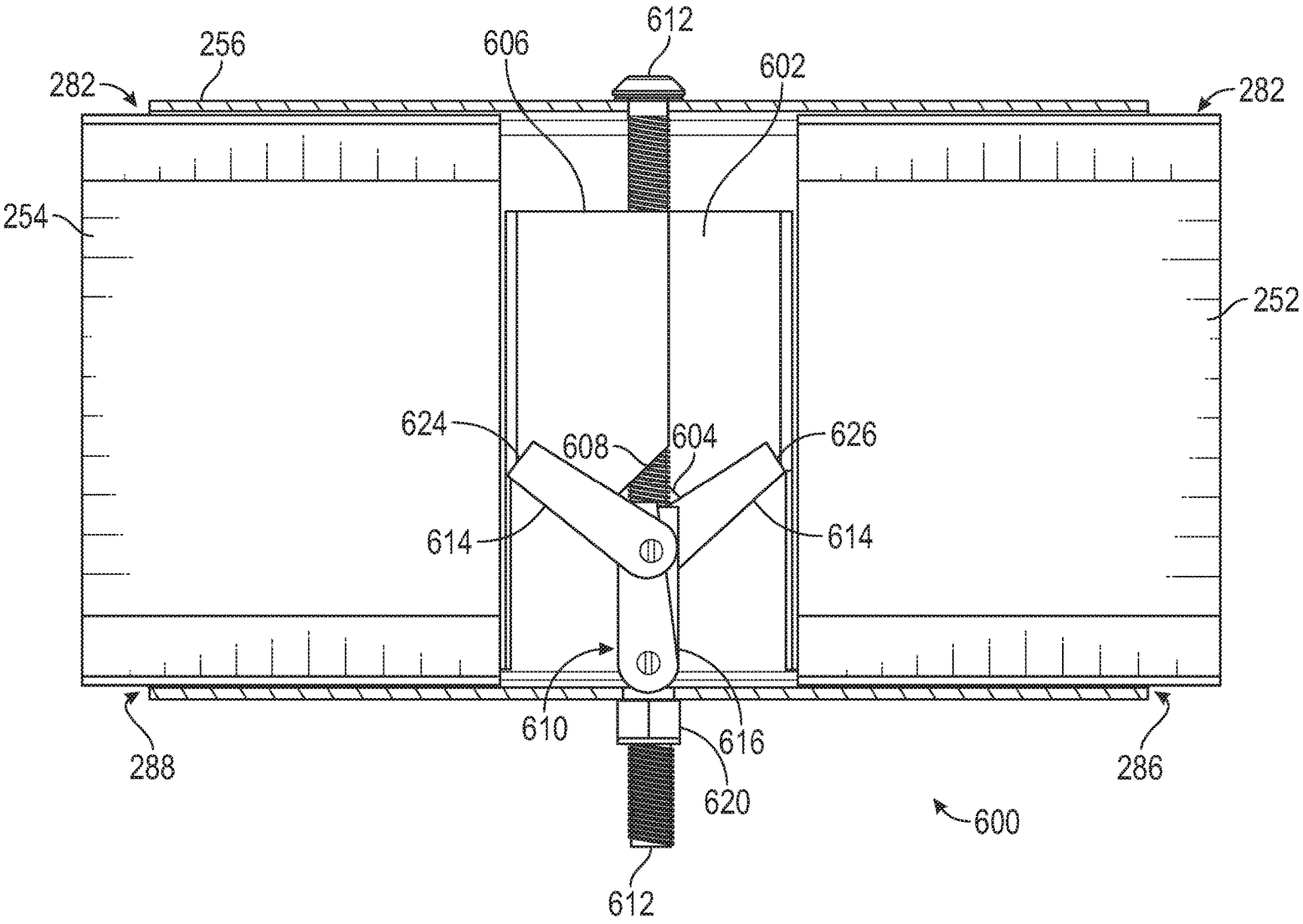
FIG. 20 is a cross-sectional view of another example of a biasing assembly for use with the rail mounting assembly of FIG. 8, with the biasing assembly in an extended position and taken from the rear of the biasing assembly.

Referring now to FIG. 20, another example of a biasing assembly 600 that can be provided with the rail mounting assembly 250, is shown. The biasing assembly 600 is similar to the biasing assembly 500 and shares many of the same features and components as the biasing assembly 500, but differs in some aspects, such as in the structure and actuation of the biasing element 610. Therefore, elements of the biasing assembly 600 that are similar to those of the biasing assembly 500 are identified with numerals increased by 100, with it being understood that the description of the like parts of the biasing assembly 500 applies to the biasing assembly 600, unless otherwise noted.

The biasing assembly 600 is similar to the biasing assembly 500 in terms of the directional actuation and not between a limited number of predetermined positions, but differs in the structure and operation of the biasing element 610. The biasing assembly 600 is illustrated herein in the extended position, with the rail mounting brace 252 including a deflecting partition 602 and the rail mounting brace 254 including a second deflecting partition 606, with the deflecting partitions 602, 606 defining deflecting surfaces 604, 608, respectively. An actuator 612 is operably coupled to the biasing element 610, illustrated herein as a toggle 610. The toggle 610 can define a toggle body 616 from which toggle arms 614 extend, and further act as catch surfaces 624, 626 against the deflecting surfaces 604, 608. The toggle 610 and the actuator 612 are further operably coupled via a nut 620.

Before the toggle 610 has reached the extended position, such as when the toggle 610 is first applied to the biasing assembly 600 or is in an initial, un-extended position, the bolt 612 and nut 620 with the toggle 610 can be provided to the biasing assembly 600, such as in an un-extended position wherein the toggle arms 614 are deflected into an un-extended position where they are retaining along the length of the bolt 612. Upon actuation of the biasing assembly 600, by sufficient turning of the actuator 612 to cause the toggle 610 to move out of deflecting engagement with the partitions 602, 606, which then allows the toggle arms 614 to be freed from interference with the deflecting surfaces and to move into the extended position, at which point removal by reversing the movements is prevented by the toggle arms 614 bearing against the partitions 602, 606 and/or the deflecting surfaces 604, 608. In this way, the toggle 610 can act to comprise a locking mechanism that prevents the rail mounting braces 252, 254, and in particular the rear portions 282 thereof, from moving toward one another.

Figure 21:
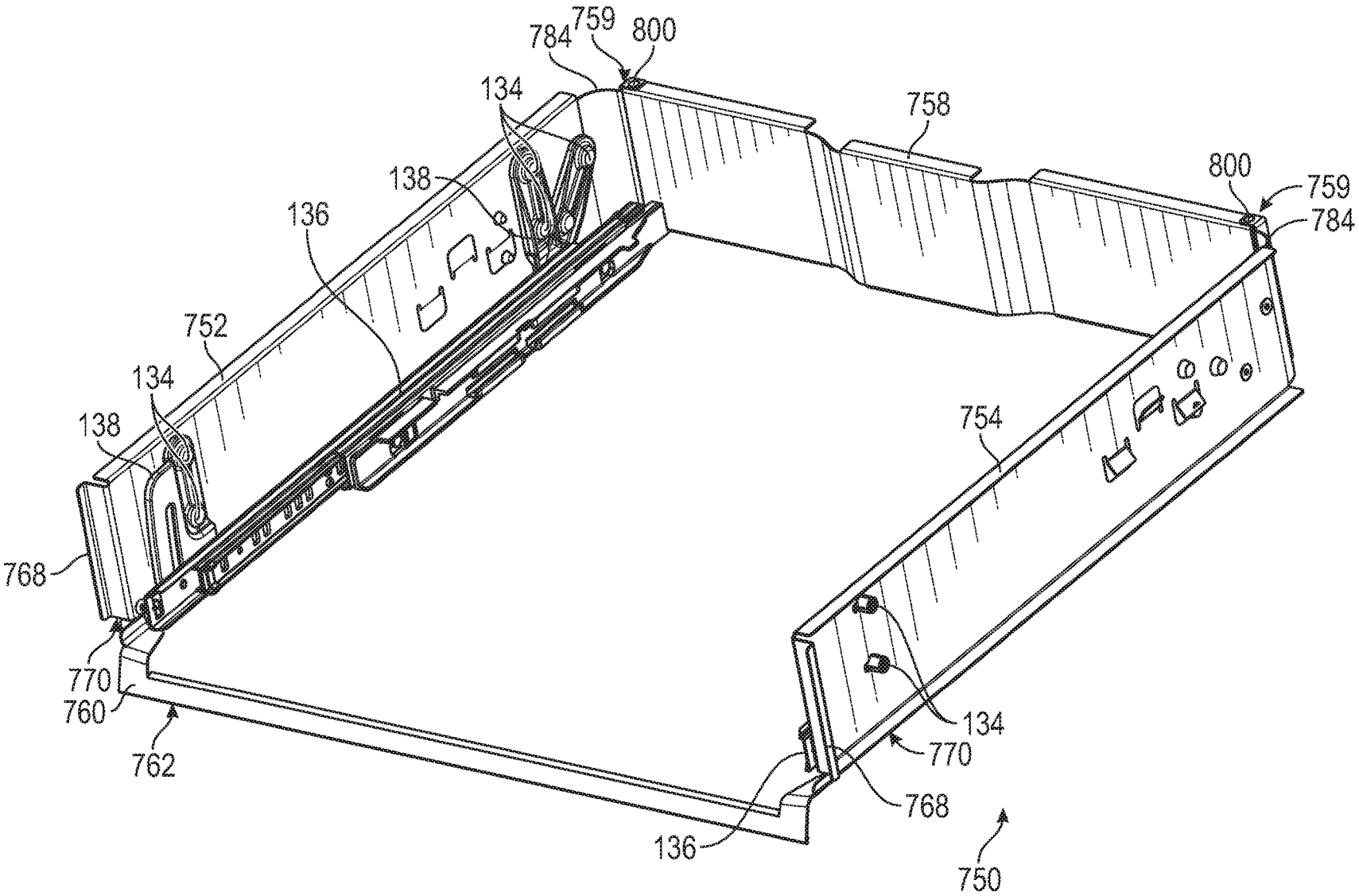
FIG. 21 is a perspective view of another example of a rail mounting assembly for use with the dishwasher of FIG. 1.

Referring now to FIG. 21, another example of a rail mounting assembly 750, a pair of rail mounting braces 752, 754, and a pair of rail assemblies 136 for use with the dishwasher 10 is shown. The rail mounting assembly 750, rail mounting braces 752, 754, and rail assemblies 136 are similar to the rail mounting assembly 250, rail mounting braces 252, 254, and rail assemblies 136, and share many of the same features and components as the rail mounting assembly 250, rail mounting braces 252, 254, and rail assemblies 136, but differ in some aspects, such as in the structure of and the coupling between the rail mounting braces 752, 754. Therefore, elements of the rail mounting assembly 750, rail mounting braces 752, 754, and rail assemblies 136 that are similar to those of the rail mounting assembly 250, rail mounting braces 252, 254, and rail assemblies 136 are identified with numerals increased by 500, with it being understood that the description of the like parts of the rail mounting assembly 250, rail mounting braces 252, 254, and rail assemblies 136 applies to the rail mounting assembly 750, rail mounting braces 752, 754, and rail assemblies 136, unless otherwise noted.

The rail mounting assembly 750 is similar to the rail mounting assembly 250 in that the rail mounting braces 752, 754 have a similar overall structure and layout, but differs from the rail mounting assembly 250 in that the rail mounting side braces 752, 754 have a different actuation structure for movement to an extended position, and also are coupled differently to one another. The rail mounting side braces 752, 754 and corresponding paired rail assemblies 136 are still spaced from one another so as to be positioned adjacent opposite side walls 140 and are provided as flipped or mirror images to one another. The mounting of the rail assemblies 136 to the rail mounting side braces 752, 754 can be provided in the same manner, such that at least one mounting bracket 138 couples each rail assembly 136 with one of the rail mounting side braces 752, 754, and such as by the use of at least one fastening element 134 that extends through the rail mounting brace 752, 754. While the rail mounting braces 252, 254 are provided as individual structures with portions extending along different directions or different tub walls 140, 142, 144, and further such that the rail mounting braces 252, 254 are telescopingly coupled relative to one another, the rail mounting side braces 752, 754 are provided more specifically as a pair of rail mounting side braces 752, 754.

The rail mounting assembly 750 further comprises a rear brace 758 that is provided along the rear wall 144, but that differs from the cross brace 256 of the rail mounting assembly 250 at least in that the rear brace 758 of the rail mounting assembly 750 extends along the width of the rear wall 144 to extend between the side walls 140 and to define opposing ends 759 of the rear brace 758. Each of the rail mounting side braces 752, 754 extends along a different one of the opposing side walls 140, such as to extend between the rear wall 144 and the access opening or open face 18. Further, each of the rail mounting side braces 752, 754 can further define a corner portion 784 at the coupling between each rail mounting side brace 752, 754 and the one of the opposing ends 759.

Further, each of the rail mounting side braces 752, 754 is coupled to one of the opposing ends 759 of the rear brace 758, for example, such that the rail mounting side braces 752, 754 are each rotatably coupled to one of the opposing ends 759. In one example, the rotatable coupling can be provided as a hinged coupling. The rail mounting side braces 752, 754 are each coupled to one of the opposing ends 759 specifically to rotate outwardly from the rear brace 758 into an installed position, in which the rail mounting side braces 752, 754 extend along the side walls 140. Each rail mounting side brace 752, 754 is rotatably coupled to the one of the opposing ends 759 for rotation into the installed position, and more specifically about a rotatable coupling 800 defining the axis of rotation 800 for the rail mounting side braces 752, 754. It is also contemplated that the rail mounting assembly 750 can comprise any suitable type of locking mechanism, configured such that each rail mounting side brace 752, 754 can be prevented from rotating back out of the installed position.

The rail mounting side braces 752, 754 each further comprise a bottom surface 770, which can be provided in contact with at least a portion of the bottom wall 142, such as the bottom edge portion 146, and can be thought of analogous to the downwardly depending flange 170 in some ways, and further similar to the bottom surface 270. Additionally, the rail mounting side braces 752, 754 each further comprise a front edge 768, which can be thought of as analogous to the front edge 168, as well as positioned similarly to the open ends 278, but having a surface defining the front edge 168, rather than the open end 278. The rail mounting assembly 750 is further illustrated herein as including the front cross brace 760 to extend between the rail mounting side braces 752, 754, and further to define the front edge 762, which can be configured or positioned for engagement with a portion of the tub 14 or dishwasher 10. It will be understood that the front cross brace 760 can have the same structure and properties as described previously with respect to the front cross brace 160, so as to provide the most additional stability to the rail mounting assembly 750.

While the rail mounting side braces 752, 754 are not illustrated herein as including as many dedicated engagement features as the rail mounting assembly 150 included, it will be understood that the aspects of the disclosure are still applicable. For example, the rail mounting side braces 752, 754 can include an opening or at least an indentation feature for engagement with the protrusions 148 of the tub 14. In addition, it should be appreciated that the entire profile and perimeter defined by the rail mounting assembly 750 can be selected so as to be complementary with the perimeter of the tub 14 for providing engagement functions for the rail mounting assembly 750.

Figure 22:
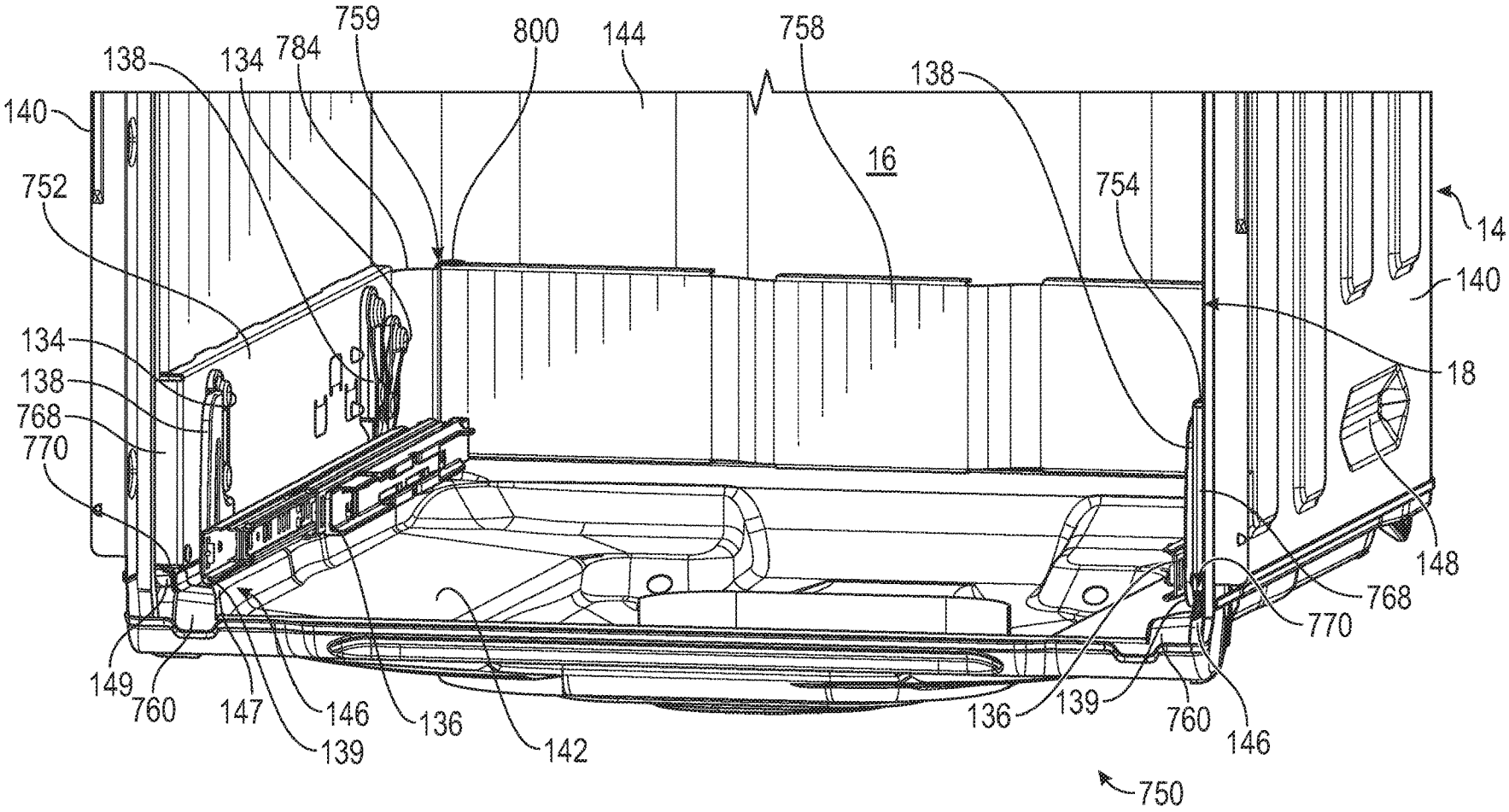
FIG. 22 is a perspective view of the rail mounting assembly of FIG. 21 provided within and coupled with the tub of the dishwasher of FIG. 1.

Turning now to FIG. 22, the rail mounting assembly 750 is shown in an installed position within and coupled to the tub 14 for a better view of the coupling and engagement between the rail mounting assembly 750 and the tub 14. While no receiving opening 172 was illustrated within the rail mounting assembly 750, the protrusion 148 can be seen with the tub 14, and it is contemplated that the rail mounting side braces 752, 754 could include some sort of detent or structural feature for engaging with the protrusion 148. Further, the engagement between the rail mounting assembly 750 and the bottom wall 142 of the tub 14 is illustrated. The rail mounting side braces 752, 754, rather than including a downwardly depending flange or skirt as in the rail mounting assembly 150, define a bottom surface 770, as in the rail mounting assembly 250, which can be substantially flat. As the bottom surface 770 is not contoured to fit along with the contours of the first and second raised rims 147, 149, the bottom surface 770 can instead be positioned to rest entirely, or substantially entirely, on the second, or outermost raised rim 149, such that the rail mounting assembly 750 abuts and is supported by the second raised rim 149 of the tub bottom wall 142.

Figure 23:
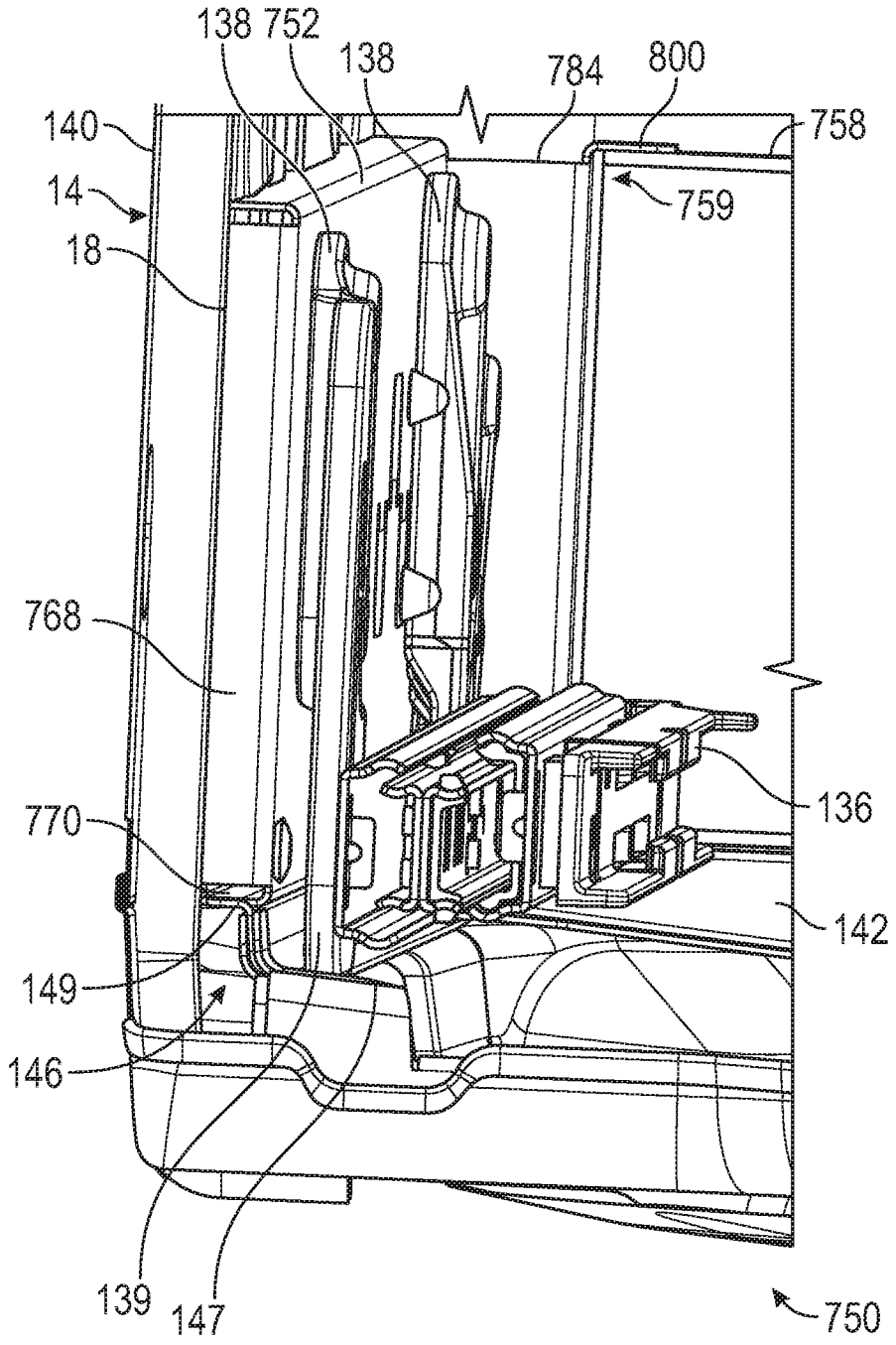
FIG. 23 is an enlarged perspective view of a portion of the rail mounting assembly and the tub of FIG. 22.

Turning now to FIG. 23, while the bottom surface 770 is flat and does not overhang or overlie the bottom wall 142 beyond the second raised rim 149, it can be better seen in this view that the mounting brackets 138 that are coupled to the rail mounting braces 752, 754 further comprise a downwardly depending portion 139 that extends below a lowermost extent of the bottom surface 770, as in the rail mounting assembly 250. Since the bottom surface 770 rests on the second raised rim 149, with the mounting bracket 138 protruding both inwardly and downwardly from the rail mounting braces 752, 754, the mounting bracket 138, and in particular the downwardly depending portion 139, can be thought of and seen as extending over and overlying the first raised rim 149. Further, it is contemplated that, in one example, the mounting bracket 138 and the downwardly depending portion 139 could extend from the rail mounting braces 752, 754 such that the bottom surface 770 overlies and rests on the second raised rim 149, while the mounting bracket 138, and in particular the downwardly depending portion 139, can extend to the extent that the downwardly depending portion 139 extends out over to overlie the first raised rim 147, as shown, but could even further protrude downwardly to the extent that the downwardly depending portion 139 can abut the first raised rim 147, so as to be at least partially supported by the tub bottom wall 142.

Figure 24:
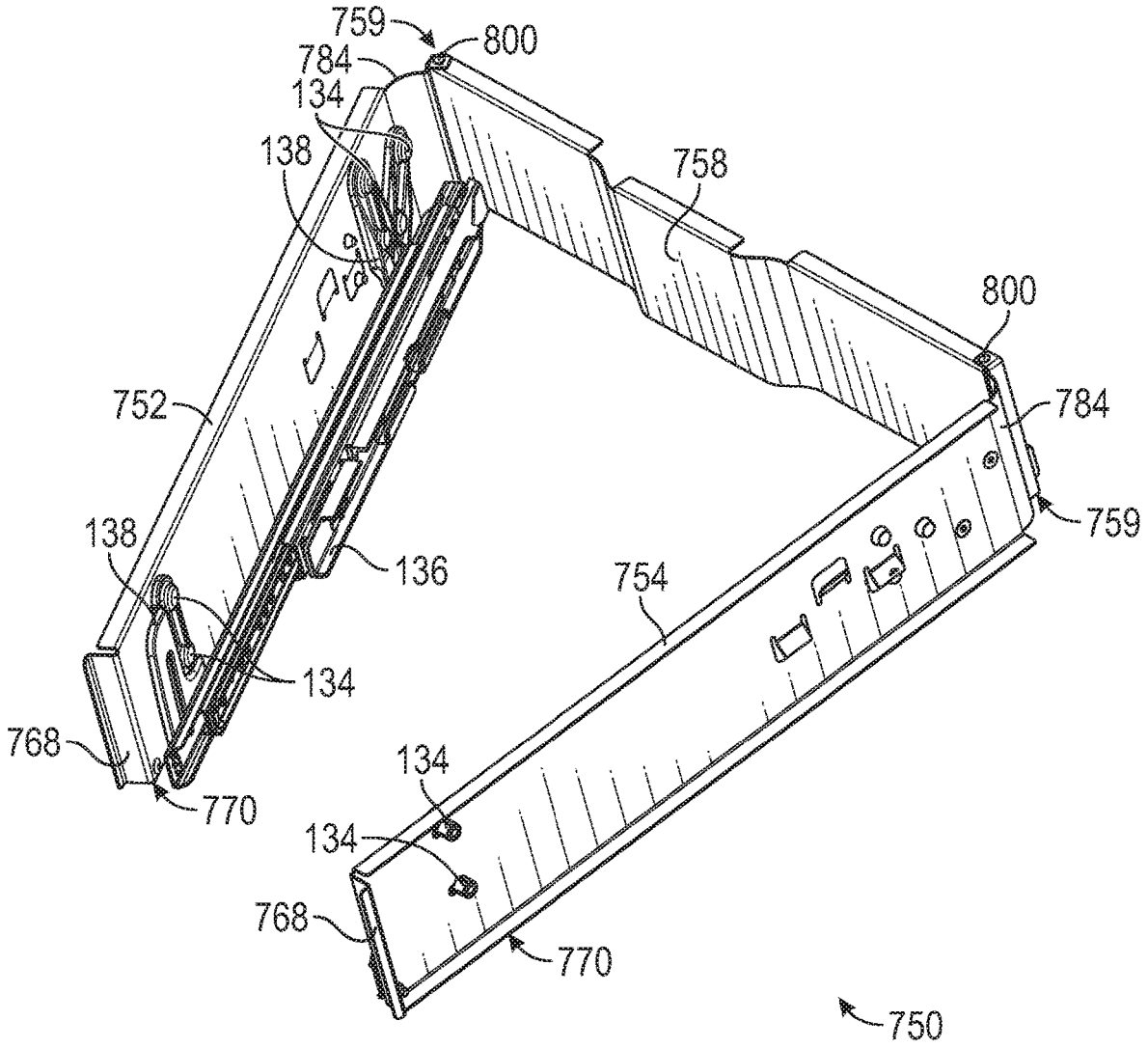
FIG. 24 is a perspective view of the rail mounting assembly of FIG. 21 with the rail mounting assembly in an unextended position.

Turning now to FIG. 24, the rail mounting assembly 750 is illustrated with the rail mounting side braces 752, 754 at least partially rotated inwardly toward the rear brace 758, such as in a non-installed position. When the rail mounting side braces 752, 754 are in the non-installed position the rail mounting side braces 752, 754 can rotate freely relative to the rear brace 758 to be rotated inwardly toward the rear brace 758 to any feasible desired extent, such as for storage or transport of the rail mounting assembly 750 prior to installation. Upon installation, the rail mounting side braces 752, 754 are rotated outwardly from the rear brace 758 into the installed position. Further, and optionally, the rail mounting side braces 752, 754 can then be locked into the installed position by any suitable locking mechanism or assembly for preventing the rail mounting side braces 752, 754 from rotating out of the installed position.

The aspects described herein set forth a variety of assemblies and approaches for improving the way in which a lower dish rack is coupled to drawer rails for sliding movement relative to the access opening of a dishwasher. The rail mounting assemblies described herein offer a set of approaches by which rail assemblies for a lower dish rack can be provided within the dishwasher, and without having to add more holes to the tub or result in costly solutions. The rail mounting assemblies provide ways to mount rails for a lower dish rack within the treating chamber, while minimizing the need for additional tooling or provision of more holes within the machine, as well as by minimizing complicated user interaction with the client. Such solutions as disclosed herein address the need with respect to the rail system for lower dish racks, as well as by providing many options for improved user experience and ease of operation, such as when a user must interact with or actuate a specific feature. The solutions proposed herein are also easy to install, at least in part due to more compact configurations that can be used prior to completion of the installation.

It will also be understood that various changes and/or modifications can be made without departing from the spirit of the present disclosure. By way of non-limiting example, although the present disclosure is described for use with a dishwasher having a wire dish rack, it will be recognized that the dish rack and the rail mounting assembly can be employed with various rack constructions, including molded racks, such as racks molded of plastic. By way of further non-limiting example, although the present disclosure relates to rail mounting assemblies that are described for use with a lower dish rack of a dishwasher, it will be recognized that the rail mounting assemblies and associated other components can be employed with various dish rack constructions and configurations, including upper dish racks, middle dish racks, or a third level dish rack.

To the extent not already described, the different features and structures of the various aspects can be used in combination with each other as desired. That one feature is not illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dish treating appliance for treating dishes according to an automatic cycle of operation, the dish treating appliance comprising:

a tub having at least a rear wall, a bottom wall, and a pair of opposing side walls and at least partially defining a treating chamber with an access opening;

a rail mounting assembly comprising a pair of rail mounting braces, each rail mounting brace biased outwardly against a different one of the opposing side walls and comprising a first portion extending along at least a portion of the one of the opposing side walls and a second portion extending along at least a portion of the rear wall and wherein the second portion of one of the rail mounting braces is telescopingly received within the second portion of the other of the rail mounting braces;

a rail assembly mounted to each rail mounting brace; and a dish rack slidingly mounted to the rail assemblies for movement in and out of the treating chamber relative to the access opening.

2. The dish treating appliance of claim 1 wherein the rail mounting braces abut and are supported by the bottom wall.

3. The dish treating appliance of claim 1 further comprising at least one cross brace extending between the second portions of the rail mounting braces.

4. The dish treating appliance of claim 1 wherein the second portions of each of the rail mounting braces are biased laterally outwardly from one another by a biasing assembly.

5. The dish treating appliance of claim 4 wherein the biasing assembly comprises a rotatable locking cam.

6. The dish treating appliance of claim 4 wherein the biasing assembly comprises a spring.

7. The dish treating appliance of claim 4 wherein the biasing assembly comprises a rack and pinion.

8. The dish treating appliance of claim 4 wherein the biasing assembly comprises a toggle.

9. The dish treating appliance of claim 4 wherein the biasing assembly comprises a locking mechanism to prevent the second portions from moving toward one another.

10. A dish treating appliance for treating dishes according to an automatic cycle of operation, the dish treating appliance comprising:

a tub having at least a rear wall, a bottom wall, and a pair of opposing side walls and at least partially defining a treating chamber with an access opening;

a rail mounting assembly comprising:

a rear brace provided along the rear wall and extending between the side walls to define opposing ends;

a pair of side braces, each of the side braces rotatably coupled to one of the opposing ends to rotate outwardly from the rear brace into an installed position, where each side brace extends along a different one of the opposing side walls, between the rear wall and the access opening; and a rail assembly mounted to each side brace; and a dish rack slidingly mounted to the rail assemblies for movement in and out of the treating chamber relative to the access opening.

11. The dish treating appliance of claim 10 wherein the rear brace and the side braces abut and are supported by the bottom wall.

12. The dish treating appliance of claim 10 wherein the rail mounting assembly further comprises at least one cross brace extending between the side braces.

13. The dish treating appliance of claim 10 wherein each of the side braces are hingedly coupled to a different one of the opposing ends.

14. The dish treating appliance of claim 10 wherein the rail mounting assembly further comprises a locking mechanism preventing each of the side braces from rotating out of the installed position.

15. A dish treating appliance for treating dishes according to an automatic cycle of operation, the dish treating appliance comprising:

a tub having at least a rear wall, a bottom wall, and a pair of opposing side walls and at least partially defining a treating chamber with an access opening;

a rail mounting assembly comprising a pair of rail mounting braces, each rail mounting brace biased outwardly against a different one of the opposing side walls and comprising a first portion extending along at least a portion of the one of the opposing side walls and a second portion extending along at least a portion of the rear wall and wherein the second portions of each of the rail mounting braces are biased laterally outwardly from one another by a biasing assembly a rail assembly mounted to each rail mounting brace; and a dish rack slidingly mounted to the rail assemblies for movement in and out of the treating chamber relative to the access opening.

16. The dish treating appliance of claim 15 wherein each of the rail mounting braces abuts the different one of the opposing side walls.

17. The dish treating appliance of claim 15 further comprising a second set of rail assemblies mounted to the side walls and positioned above the rail mounting assembly, wherein each of the rail mounting braces are retained between a different one of the second set of rail assemblies and the different one of the opposing side walls.

18. The dish treating appliance of claim 15 wherein the second portion of one of the rail mounting braces is telescopingly received within the second portion of the other of the rail mounting braces.

* * * * *